US005111907A

United States Patent [19]

Kishi

[11] Patent Number: 5,111,907

[45] Date of Patent: May 12, 1992

[54] LIFTING APPARATUS

[75] Inventor: Mitsuhiro Kishi, Tochigi, Japan

[73] Assignee: Japanic Corporation, Tochigi, Japan

[21] Appl. No.: 657,636

[22] Filed: Feb. 19, 1991

[30] Foreign Application Priority Data

Feb. 20, 1990 [JP] Japan ..... 2-39374
Jul. 16, 1990 [JP] Japan ..... 2-187622

[51] Int. Cl.[5] ..... E06C 5/04; E04G 1/22

[52] U.S. Cl. ..... 182/63; 182/17; 182/116; 182/145; 182/127

[58] Field of Search ..... 182/63, 145, 146, 116, 182/17, 210, 127; 187/9 E, 11

[56] References Cited

U.S. PATENT DOCUMENTS

| | | | |
|---|---|---|---|
| 470,112 | 3/1892 | Ehrentraut | 182/63 |
| 2,632,530 | 3/1953 | Wagner | 182/63 |
| 3,095,945 | 7/1963 | Mitchell | 182/63 |
| 3,664,458 | 5/1972 | Stern | 182/63 |
| 3,819,013 | 6/1974 | Crum | 182/145 |
| 4,258,825 | 3/1981 | Collins | 182/63 |
| 4,427,093 | 1/1984 | Wehmeyer | 182/63 |
| 4,458,785 | 7/1984 | Bushnell | 182/145 |

*Primary Examiner*—Reinaldo P. Machado
*Attorney, Agent, or Firm*—Flynn, Thiel, Boutell & Tanis

[57] ABSTRACT

A lifting apparatus having a base, a platform disposed above the base, and a vertically extendable mast arrangement coupled between the platform and base to effect vertical lifting of the platform. The mast arrangement normally includes a pair of vertically extendable mast assemblies disposed in parallel relationship, and each having plural vertically elongate masts disposed in vertical sliding relationship with one another. One mast is fixed to and projects upwardly from the base, another is fixed to the platform, and at least one additional mast is vertically slidably coupled therebetween. Each mast has sequencing structure associated therewith for requiring that the individual masts be vertically extended in a controlled sequence, and also has a locking structure for vertically fixedly coupling adjacent masts together when one is vertically extended relative to the adjacent mast. A winding arrangement, including pulleys mounted on the masts and engaged with a cable, couple the base and platform to control vertical raising and lowering.

22 Claims, 22 Drawing Sheets

LIFTING APPARATUS

FIELD OF THE INVENTION

The present invention relates to a lifting apparatus capable of raising a platform provided thereon so that operators or materials loaded on the platform can be raised to an elevated location, and particularly to a lifting apparatus capable of raising the platform by a stretchable mechanism composed of a plurality of masts.

BACKGROUND OF THE INVENTION

There has been employed many kinds of lifting apparatus capable of raising operators and materials to an elevated location for assembling, painting, repairing a building and the like or repairing and inspecting an indoor ceiling, or maintaining illumination equipment and the like.

There has also been recently employed a lifting apparatus capable of raising the platform on which the operators and materials are loaded to an elevated location far beyond the operator's reach. In working at a position which is far beyond the operator's reach, ladders or scaffolds are conventionally employed. If ladders are used, the height which can be reached is limited and it is laborious to raise the materials. If scaffolds are assembled at the working site, it takes much time for assembling and removing the scaffolds which results in low efficiency.

To meet the demand, there has been employed several lifting apparatus capable of stretching vertically and having wheels capable of moving on the floor. In such a lifting apparatus, a plurality of masts are assembled so as to be stretchable vertically by hydraulic apparatus or winches so that a platform fixed to the upper portion of the mast is raised or lowered vertically. However, when the working platform is raised to an elevated location, the number of stretchable masts is increased. If the number is increased, this increases the likelihood that the stretched or extended masts may abruptly fall or develop trouble. Furthermore, it was uncertain what mast among the plurality of masts is raised so that it was difficult to raise the mast in turn with precision. Accordingly, it was desired to raise a specific mast alone among the plurality of masts and the masts raised upward in turn are fixed to the other masts by locking means.

In such a lifting mechanism having a plurality of masts for raising the platform, the structure thereof is simple. It is possible to raise the platform on which operators are loaded to a position higher than ladders or step ladders, so that this kind of lifting apparatus has been employed in many cases. However, there has occurred the problem of raising the platform in safety.

Accordingly, it was desired to specify the mast to be raised in turn among the plurality of masts to thereby raise the masts step by step. Furthermore, it was desired to develop a mechanism for connecting the masts with each other with assurance and preventing the platform from falling.

SUMMARY OF THE INVENTION

It is therefore an object of the present invention to provide a lifting apparatus capable of meeting the need in the lifting apparatus mentioned above.

To achieve the above object, a first aspect of the present invention comprises a base, two stretchable mast mechanisms each composed of a fixing mast vertically fixed to the base, a middle mast stretchable vertically relative to the fixing mast, an upper mast stretchable vertically relative to the middle mast, a movable mast stretchable vertically relative to the upper mast, a platform fixed to the movable mast, a winch mounted on the base, winding means composed of a wire and pulleys, the wire being wound around pulleys provided at upper and lower ends of the respective fixing, middle and upper mast and connected to the movable mast at the other end thereof, a first fixing means for selectively connecting the middle mast with the upper mast, a second fixing means selectively connecting the upper mast with the movable mast, a first releasing means for releasing the engagement between the upper mast and the middle mast when the movable mast is raised relative to the upper mast, and a second releasing means for releasing the engagement between the middle mast and the fixing mast when the upper mast is raised relative to the middle mast.

To achieve the above object, a second aspect of the present invention comprises a base, two stretchable mast mechanisms each composed of a fixing mast vertically fixed to the base, a middle mast stretchable vertically relative to the fixing mast, an upper mast stretchable vertically relative to the middle mast, a movable mast stretchable vertically relative to the upper mast, a platform fixed to the movable mast, a winch mounted on the base, winding means composed of a wire and pulleys, the wire being wound around pulleys provided at upper and lower ends of the respective fixing, middle and upper mast for raising the middle mast and the upper mast relative to the fixing mast, a stopping means fixed to a portion of the fixing mast, a selective engaging means fixed to the middle mast for selectively connecting with the stopping means, an unlocking means fixed to the upper mast for unlocking the engagement of the selective engaging means with the stopping means, the upper mast being moved relative to the middle mast by operating the winding means, and the middle mast being moved relative to the fixing mast by releasing the engagement of the stopping means with the selective engaging means after the unlocking means contacts the selective engaging means.

The above and other objects, features and advantages of the present invention will become more apparent from the following description taken in conjunction with the accompanying drawings.

DETAILED DESCRIPTION

First Embodiment (FIGS. 1 to 10)

Figure 1:
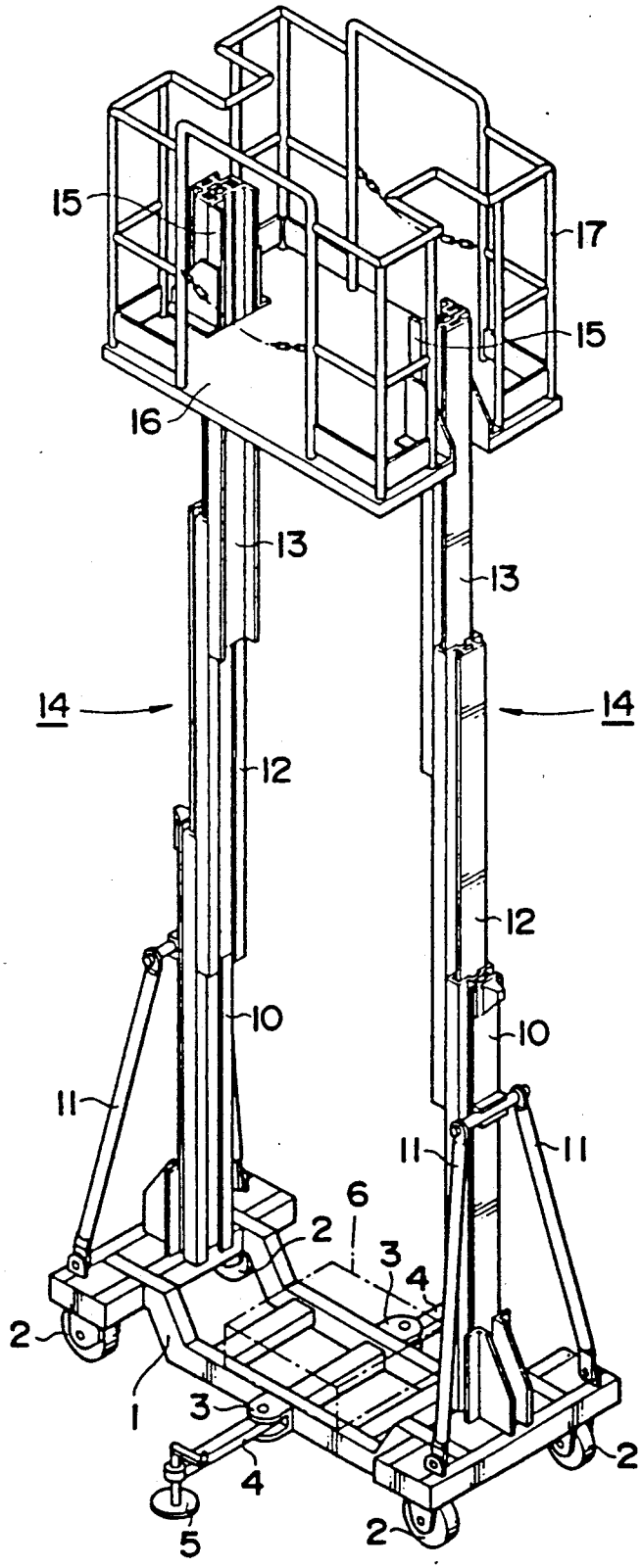
FIG. 1 is a perspective view of a lifting apparatus according to a first embodiment of the present invention and showing the platform in its uppermost position.
Figure 2:
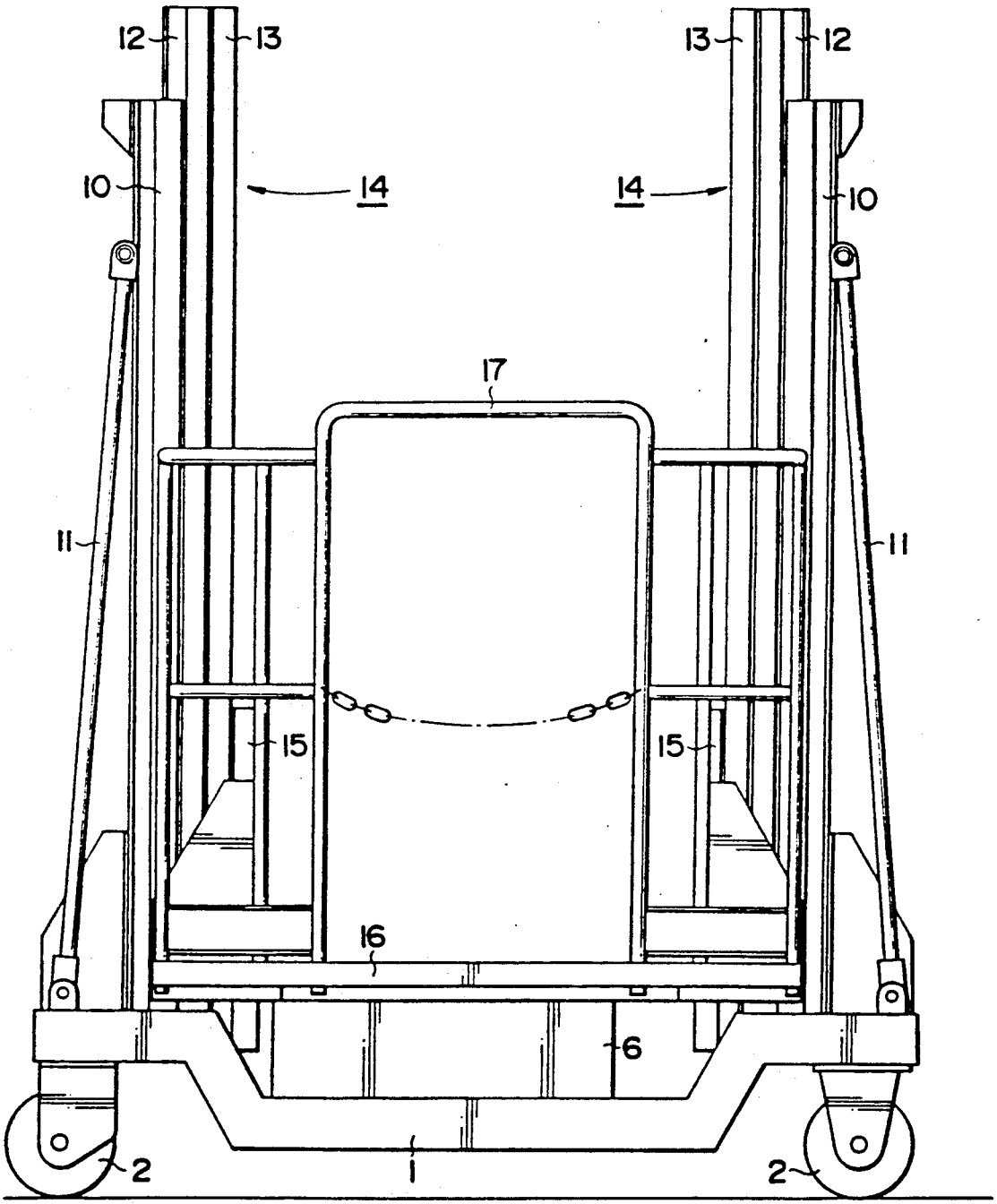
FIG. 2 is a side view of the lifting apparatus of FIG. 1 with the platform in its lowermost position.
Figure 3:
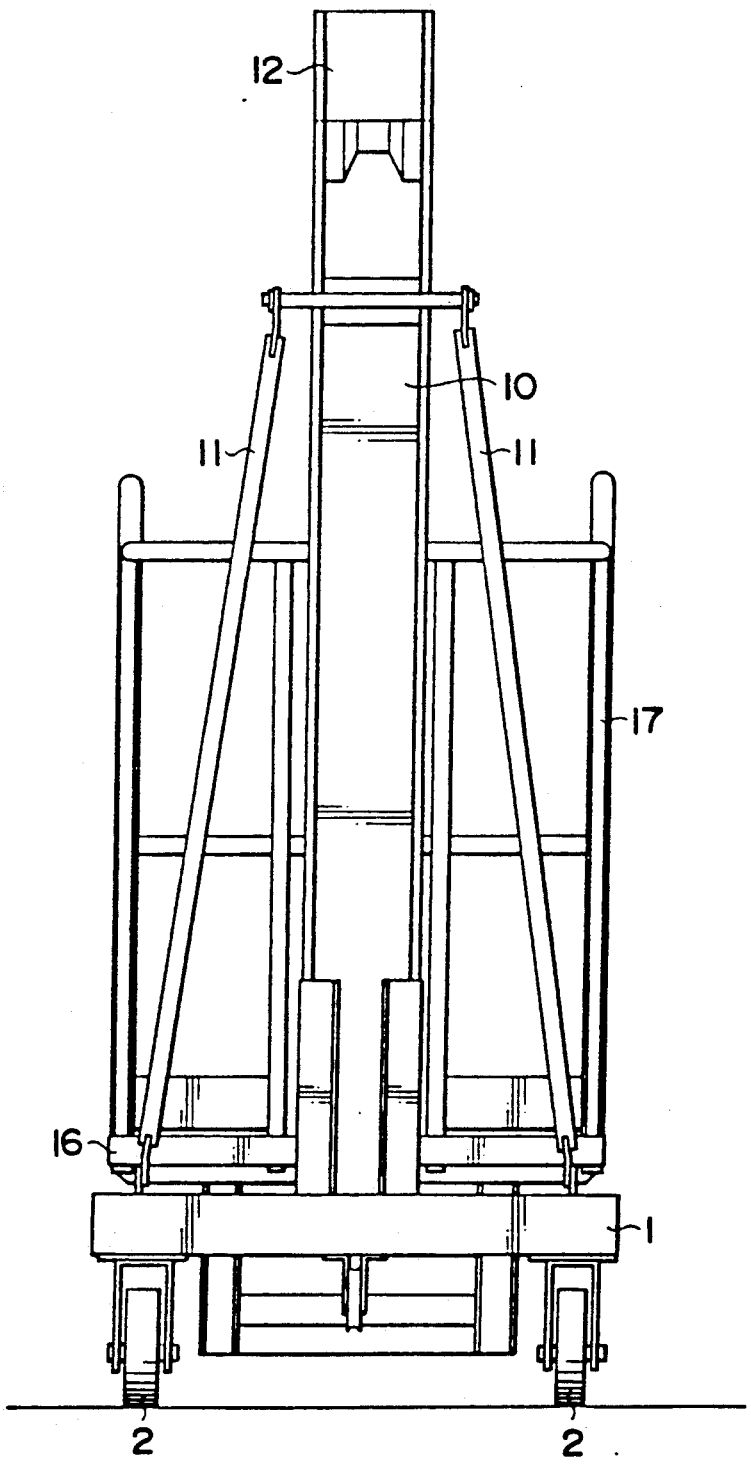
FIG. 3 is a front view of the lifting apparatus of FIG. 2.
Figure 4:
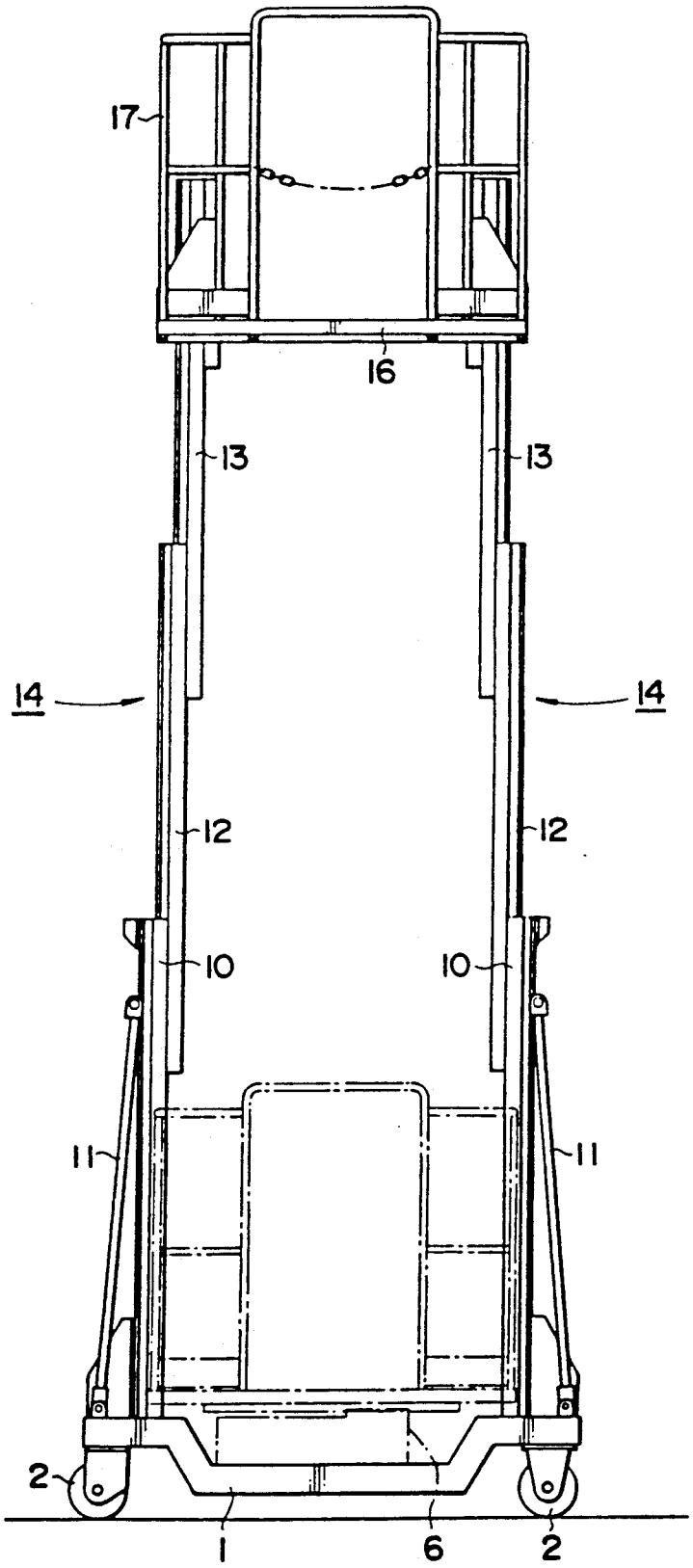
FIG. 4 is a side view of the lifting apparatus of FIG. 1 with the platform raised to its uppermost position.
Figure 5:
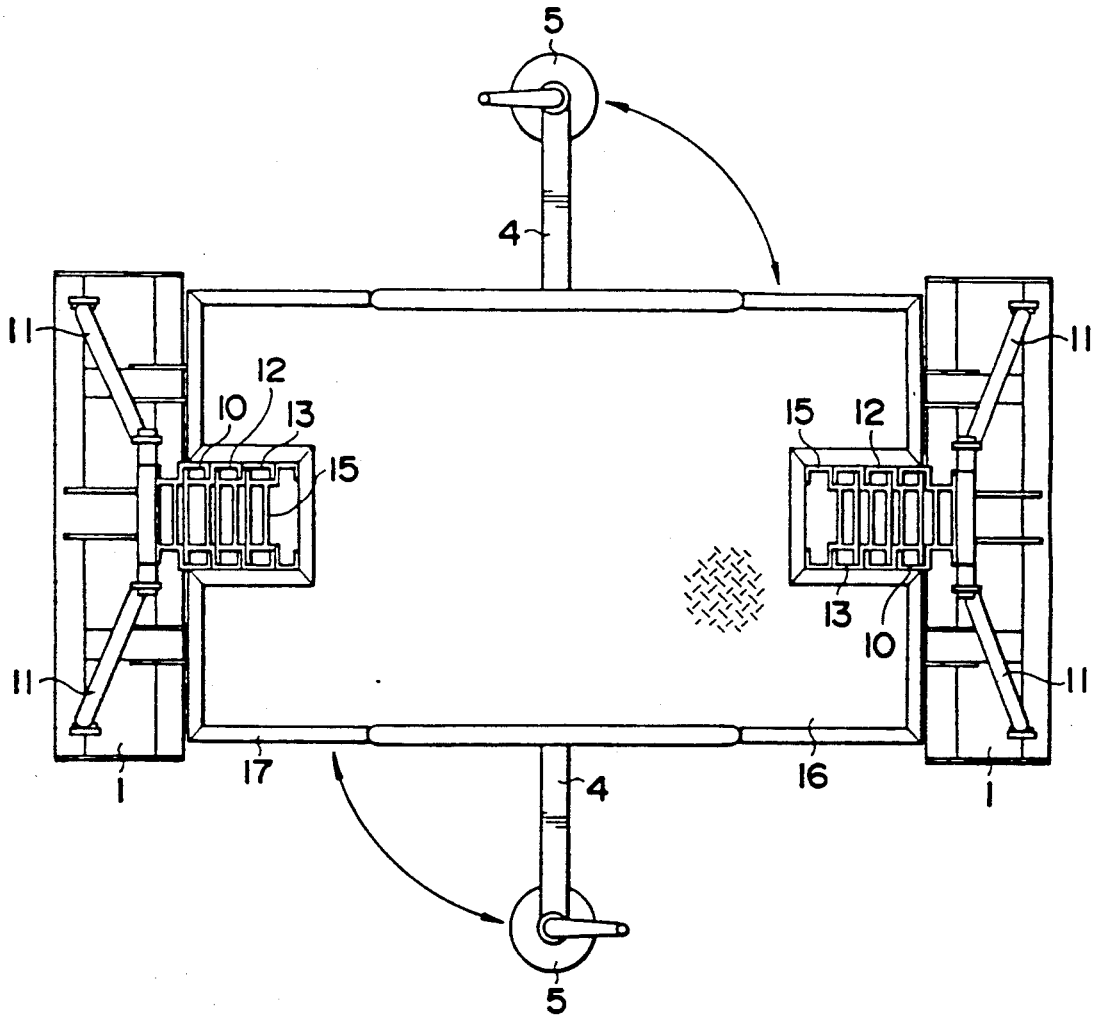
FIG. 5 is a plan view of FIG. 4.

A lifting apparatus according to a first embodiment of the invention will be described with reference to FIGS. 1 to 10.

The lifting apparatus comprises a chassis 1 assembled substantially like a ladder, front and rear wheels 2 supported on the chassis 1 whereby the chassis 1 is movable freely on a floor, shaft supporting plates 3 bent in C shape fixed to a central portion of the chassis 1 at both sides thereof, beams 4 fixed to the shaft supporting plates 3 by pivot pins and movable horizontally, fixing legs 5 fixed to the tip ends thereof serving as outriggers. The chassis 1 is bent downward and lowered at the upper central surface thereof and has a winch 6 mounted thereon and driven by motors or the like.

The lifting apparatus further comprises a pair of fixing masts 10 which are fixed to the raised end portions of the chassis and project upwardly at positions centrally between the respective front and rear wheels 2 so that the masts oppose one another in spaced relationship. A pair of supporters or struts 11 are positioned at each end of the chassis for supporting the adjacent fixing mast 10. The supporters 11 have upper ends connected to the fixing mast 10 and lower ends connected to both ends of the adjacent end surface of the chassis 1 so as to form an inverted V. The fixing masts 10 are supported vertically by the supporters 11. The fixing masts 10 have grooves extending vertically thereof and into which middle masts 12 are slidably inserted. Likewise, the middle masts 12 have grooves extending vertically thereof and into which upper masts 13 are slidably inserted. The upper masts 13 have grooves extending vertically into which movable masts 15 are slidably inserted. The fixing masts 10, middle masts 12, upper masts 13 and movable masts 15 constitute stretchable mast assemblies 14.

The pair of stretchable mast assemblies 14 are opposed with each other at a spaced interval. A flat platform 16 is disposed between the pair of stretchable mast assemblies 14. The platform 16 is rectangular and has recesses opening inwardly of the short sides thereof. The stretchable mast assemblies 14 are engaged in these recesses of the platform 16 so as to be vertically slidable. The movable masts 15 are inserted into these recesses of the platform 16 and the movable masts 15 are fixed to the platform 16. The platform 16 has a raised handrail 17 around the periphery thereof.

Figure 6:
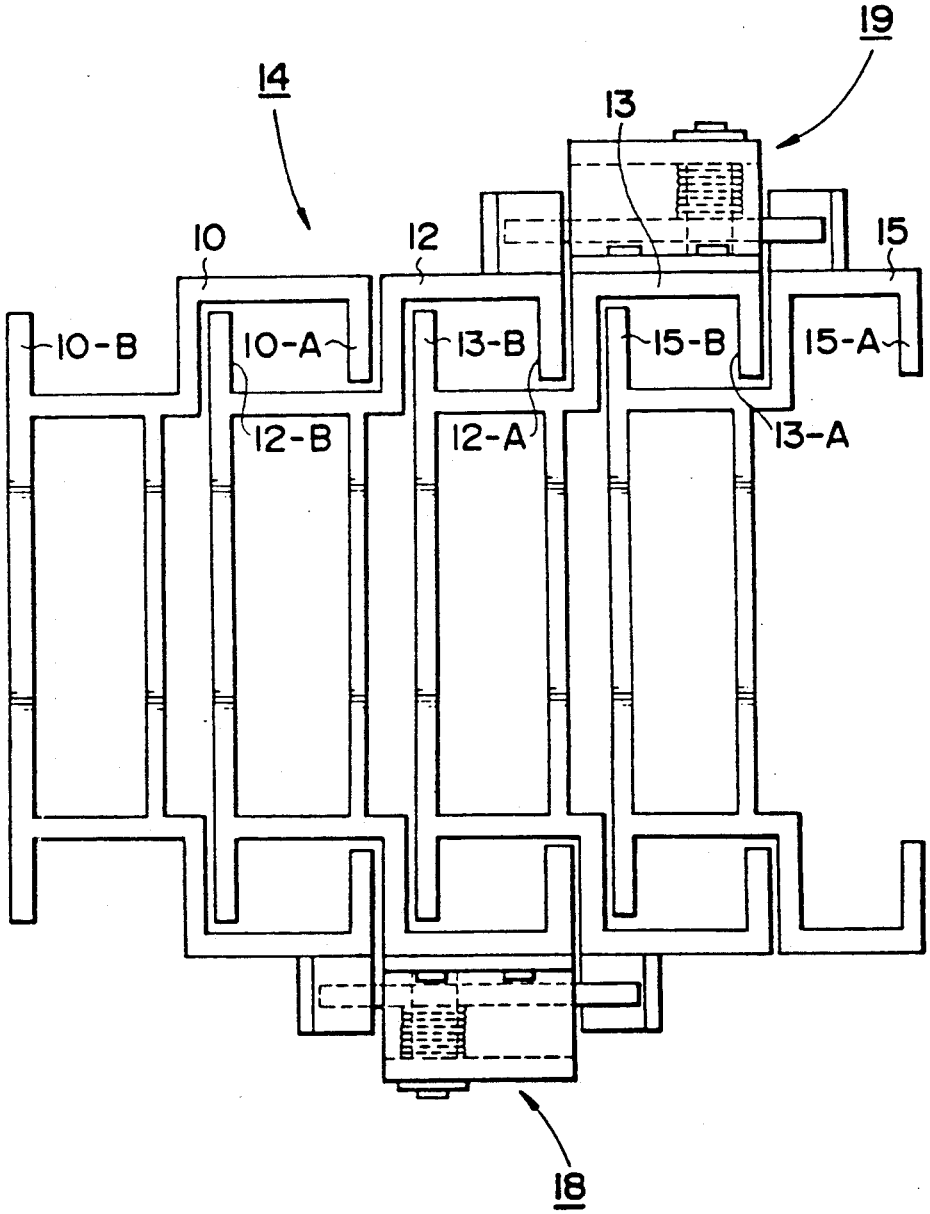
FIG. 6 is a cross sectional view showing a combination of stretchable masts for the lifting mechanism according to the first embodiment of the invention.

FIG. 6 is a cross sectional view for explaining the assembly of masts constituting the stretchable mast assembly 14.

The fixing mast 10, the middle mast 12, the upper mast 13 and the movable mast 15 are the same in cross sections thereof and are manufactured by subjecting aluminum alloy and the like to a drawing process. The fixing mast 10, the middle mast 12, the upper mast 13 and the movable mast 15 respectively have guide portions 10-A, 12-A, 13-A, 15-A formed by bending both ends of the one side surfaces thereof (inner surfaces of the opposed masts) inward in an L-shape to form a U-shaped space. There are defined flat-shaped sliding portions 10-B, 12-B, 13-B, 15-B at the other side surfaces thereof (outer surfaces). The slider portions 12-B of the middle mast 12 are inserted into the guide portions 10-A of the fixing mast 10 while the slider portions 13-B of the upper mast 13 are inserted into the guide portions 12-A of the middle mast 12. The slider portions 15-B of the movable mast 15 are inserted into the guide portions 13-A of the upper mast.

In such an assembly of these masts, the middle mast 12 is slidable vertically relative to the fixing mast 10 and the upper mast 13 is slidable vertically relative to the middle mast 12 while the movable mast 15 is slidable vertically relative to the upper mast 13. A first sequencing or stopper mechanism 18 is fixed to each middle mast 12 at an upper end of both sides thereof while a second sequencing or stopper mechanism 19 is fixed to each upper mast 13 at an upper end of both sides thereof so as to permit sequenced extension of the various masts.

Figure 7:
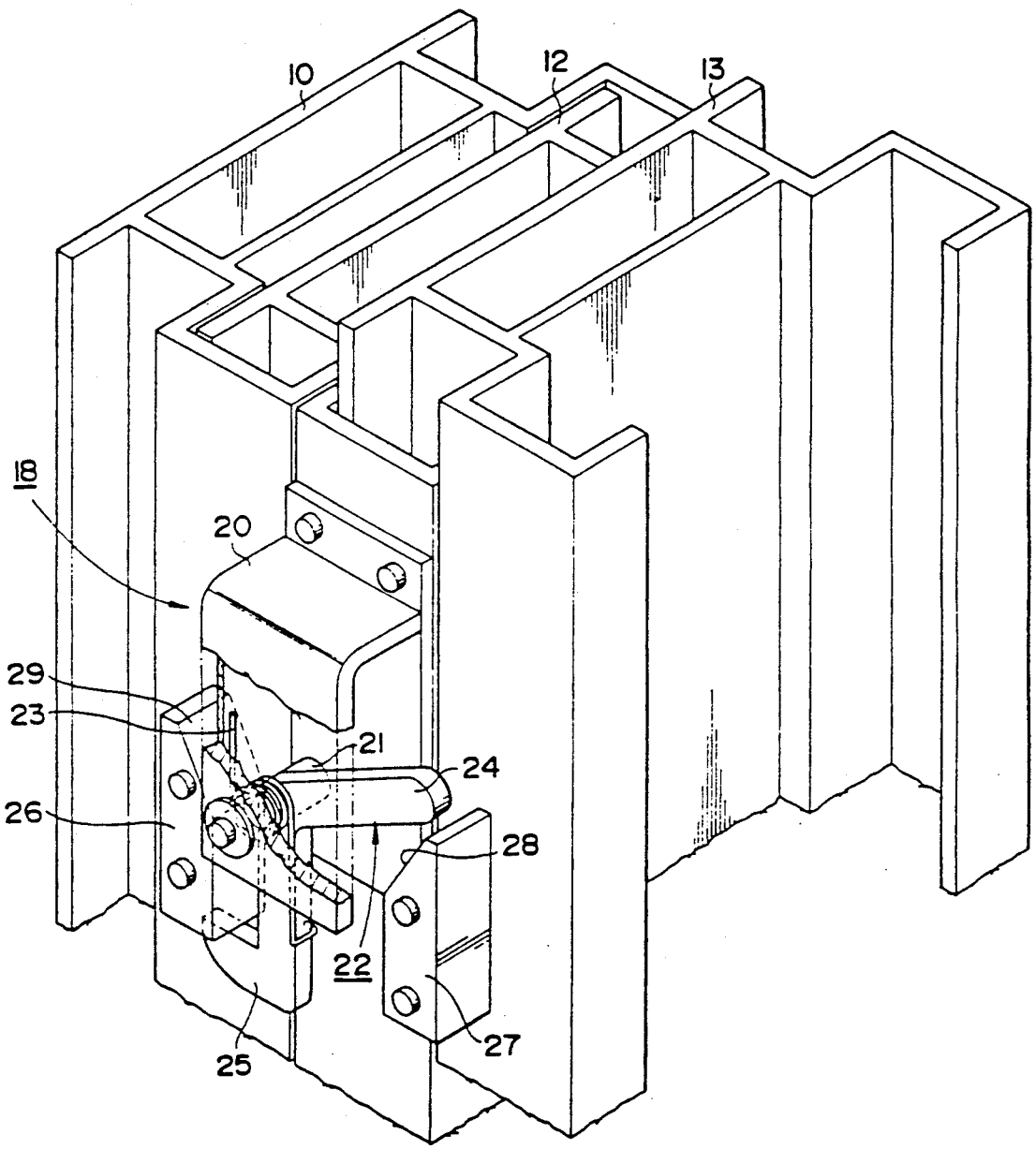
FIG. 7 is an enlarged perspective view showing a stopper mechanism for the lifting apparatus according to the first embodiment of the invention.
Figure 8:
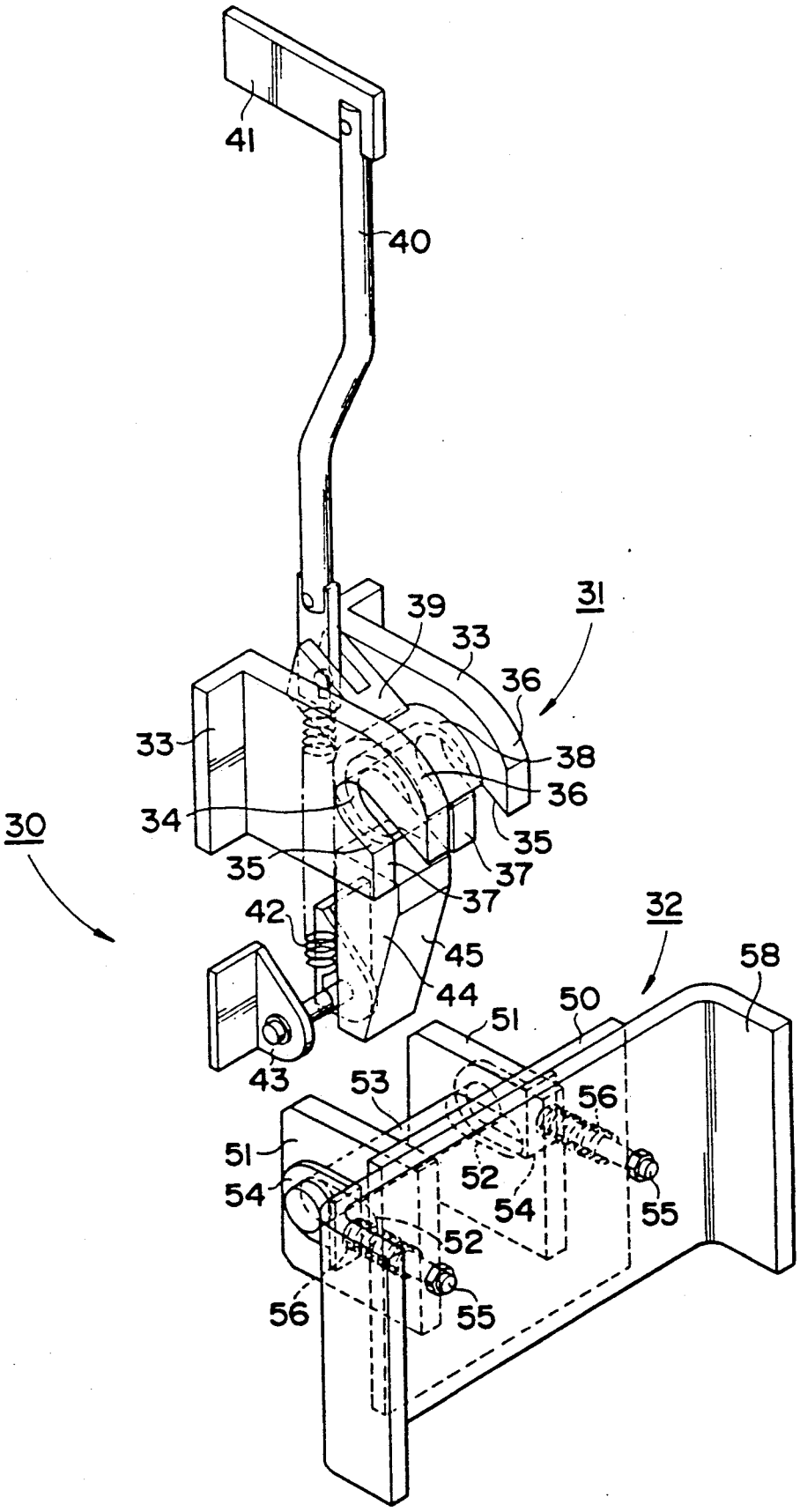
FIG. 8 is an exploded perspective view showing a locking mechanism for the lifting apparatus according to the first embodiment of the invention.

One of the first stopper mechanisms 18 is shown in FIG. 7. The second stopper mechanism 19 is not illustrated since the structure thereof is substantially the same as that of the first stopper mechanism 18.

A shaft supporter 20 having an L-shaped configuration is fixed to the upper side surface of the middle mast 12 and defines a downwardly directed opening. A shaft 21 is fixed horizontally to a central portion of the shaft supporter 20 and has an L-shaped stop lever 22 pivotally mounted thereon at the central portion thereof. The stopper lever 22 is always biased in the clockwise direction in FIG. 7 by a spring 23 wound coaxially with the shaft 21.

The stop lever 22 has one end extending in the direction of the upper mast 13 to form an operating portion 24 having a distal end protruded forward from the side surface of the middle mast 12 and the other end bent in an L-shape to form an engaging member 25 having a hook-shaped hanging portion positioned in the direction of the side surface of the fixing mast 10.

A block-shaped stopper 26 is fixed to the portion adjacent to the upper end of and at the side of the fixing mast 10 and engageable with the hanging hook portion of the engaging member 25 at the lower surface thereof.

There is defined an inclined slidable portion 29 opposed to the middle mast 12 at the upper portion of the stopper 26. A block-shaped releasing member 27 is fixed to the upper mast 13 at the side lower surface thereof. There is defined an inclined operating portion 28 at the upper portion of the releasing member 27 and opposed to the stop lever 22 so that the operating portion 28 can contact the operating member 24. The first stopper mechanism 18 is composed of the stop lever 22, the stopper 26 and the releasing member 27.

Locking mechanisms are incorporated in each mast assembly 14 of the lifting apparatus according to the first embodiment of the present invention from the point of safety. A locking mechanism 30 is described with reference to FIGS. 8 and 9.

Figure 9:
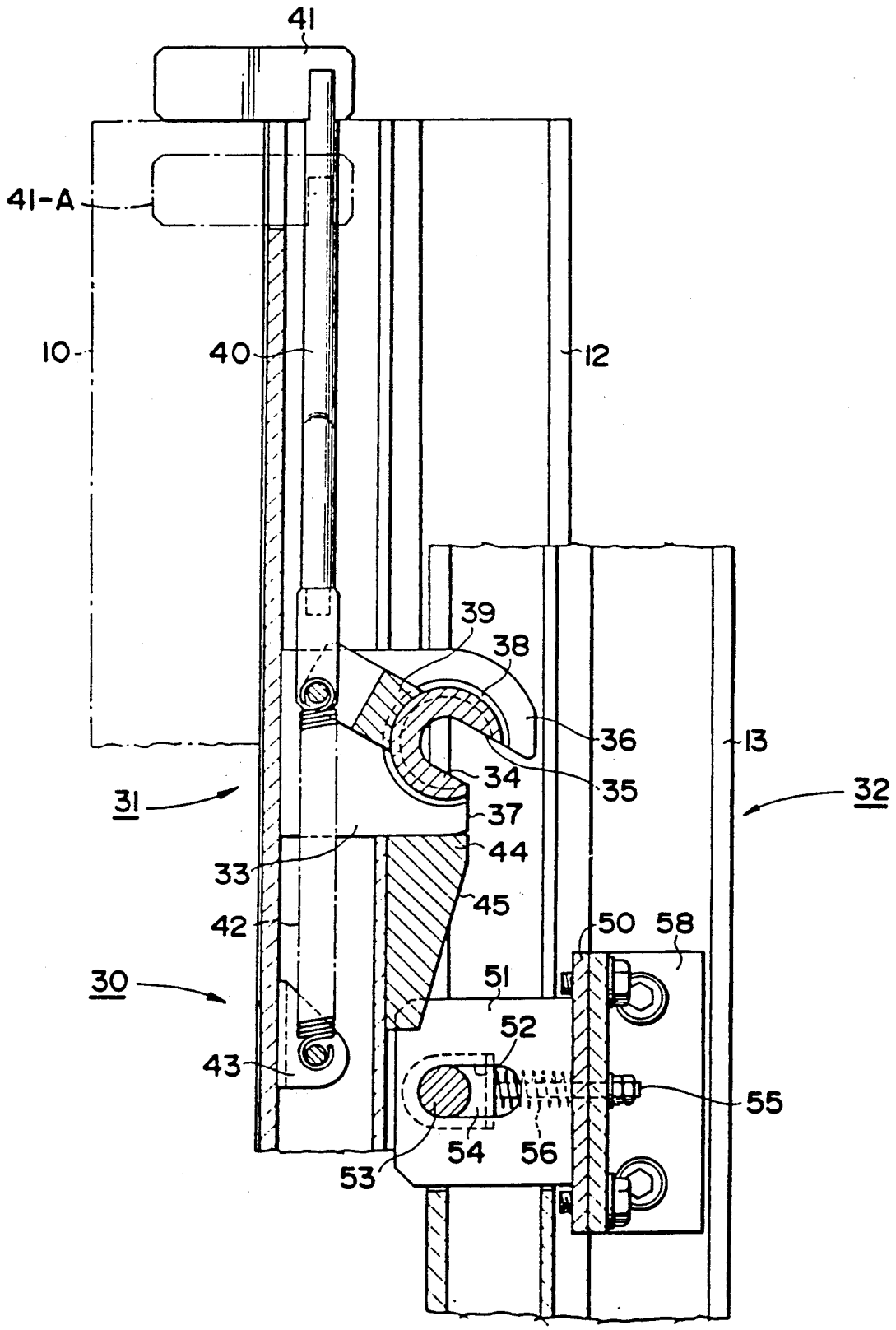
FIG. 9 is a cross sectional view showing the attachment of the locking mechanism of FIG. 8.

The locking mechanisms 30 are respectively disposed between the upper end of the middle mast 12 and the lower end of the upper mast 13, and between the upper end of the upper mast 13 and the lower end of the movable mast 15. The locking mechanism 30 comprises an engaging portion 31 and a locking pin portion 32. In FIG. 9, the engaging portion 31 is fixed to the upper end of the middle mast 12 and the locking pin portion 32 is fixed to the lower end of the upper mast 13.

The engaging portion 31 is attached to both the inner upper portion of the middle mast 12 and the inner upper portion of the upper mast 13, while the locking pin portion 32 is attached to both the outer lower portion of the upper mast 13 and the outer lower portion of the movable mast 15.

A pair of L-shaped holding members 33 are fixed to the side surfaces of the middle mast 12 for holding the engaging portion 31. The pair of holding members 33 is spaced at a given interval and a shaft fitting 34 is disposed at the central portion of the space between the pair of holding members 33 for connecting both the holding members 33. The holding members 33 have introduction grooves 35 at the central surfaces of upright portions thereof defined by inclining the upright portion downward. The introduction grooves 35 extend inside the space of the C-shaped shaft fitting 34. The holding members 33 have hook portions 36 defined at the upright portions thereof and positioned at the upper portions of the introduction grooves 35 so as to extend forward. The holding members 33 have introduction surfaces 37 defined at the upright portions thereof and positioned below the introduction grooves 35 and lower than the hook portions 36 and parallel with the side surface of the middle mast 12.

The shaft fitting 34 is C-shaped in cross section and in a circular arc at the outside thereof. A closable fitting 38 having substantially L-shaped configuration is rotatably assembled with the shaft fitting 34 at the outer periphery thereof. An arm 39 is connected to the rear surface of the closable fitting 38 and to the lower end of a rod 40 at the tip end thereof. The rod 40 is long and narrow to extend to the upper portion of the middle mast 12. An operation plate 41 is connected to the upper end of the rod 40 at right angle therewith so as to contact the upper surface of the fixing mast 10. A spring 42 has one end engaged with the lower end of the arm 39 and the other end engaged with a spring receiver 43 fixed to the middle mast 12. There is fixed a block shaped guide body 44 at the side surface of the middle mast 12 and positioned between and under the holding members 33. The guide body 44 has a cam surface 45 defined at the inclined front lower surface thereof.

The locking pin portion 32 comprises a base portion 58 fixed to lower inside portion of the upper mast 13 and having a C-shape configuration and a flat shaped supporter 50 fixed to the base portion 58. A pair of shaft plates 51 are fixed to the side surface of the supporter 50 which protrude upright with a spaced interval and have long holes 52 at the central portion thereof. A cylindrical locking pin 53 is movably inserted into the long holes 52 and has both ends fixed to holding plates 54. The holding plates 54 are connected to guide pins 55 which are slidably held by the supporter 50. Coil springs 56 are disposed around the guide pins 55 and inserted between the supporter 50 and the holding plates 54. The holding plates 54 and the locking pin 53 are always biased leftward in FIGS. 8 and 9 by the coil springs 56.

Figure 10:
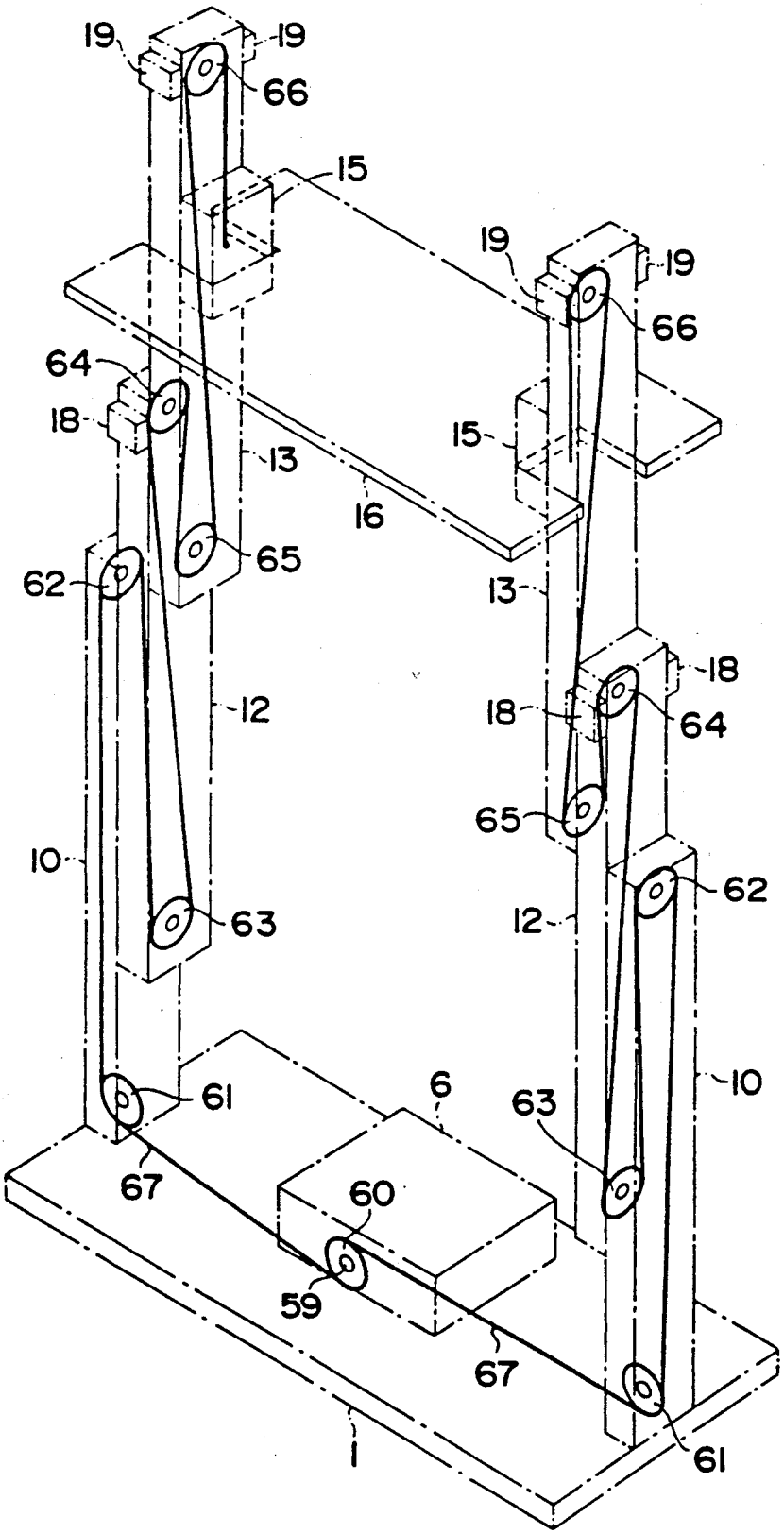
FIG. 10 is a view for explaining the winding of a control wire for the lifting mechanism according to the first embodiment of the invention.

A control wire employed in the first embodiment is wound on the masts as illustrated in FIG. 10. In FIG. 10, the middle mast 12, the upper mast 13 and the movable mast 15 are shifted for convenience of explanation, but such operation will not be affected practically.

An operation shaft 59 protrudes from the side surface of the winch 6 and is fixed to a winding drum 60. Pulleys 61 and 62 are respectively rotatably provided at the lower and upper portions of the fixing mast 10, pulleys 63 and 64 are rotatably provided at the lower and upper portions of the middle mast 12, and pulleys 65 and 66 are rotatably provided at the lower and upper portions of the upper mast 13. A lifting wire or cable 67 is wound around the winding drum 60 and wound further around successively the pulleys 61, 62, 63, 64, 65 and 66 so as to form S-shapes respectively. An end of the wire 67 is connected to the movable mast 15. In such a manner, one wire 67 is wound around the pulleys respectively provided at the lower and upper portions of the fixing mast 10, middle mast 12 and upper mast 13, with the ends of the wire being anchored to the mast 15 and the winding drum 60. Alternately, a single wire can be used with the center portion thereof anchored to the winding drum 60, and the free ends anchored to the mast 15.

The operation of the lifting apparatus according to the first embodiment of the present invention will be described hereinafter.

Described first of all is a case where the lifting apparatus is to be moved to a working site. The middle masts 12, the upper masts 13 and the movable masts 15 are respectively lowered which involves the contraction of the height of the lifting apparatus as a whole. In this state, since the wheels 2 are provided at the lower surface of the chassis 1, it is possible to rollingly move the lifting apparatus with very light force. When the chassis 1 is moved to the working site, the beams 4 at both sides of the chassis 1 are positioned at right angles relative to the chassis 1. Thereafter fixing legs 5 are lowered to contact the floor at the lower end thereof. The chassis 1 is prevented from moving by the fixing legs 5 so that the chassis 1 is temporarily fixed by preventing the chassis 1 from tipping in the side directions thereof.

Successively, the platform 16 is raised by operating the winch 6 so that the wires 67 are wound around the winding drum 60. The winding drum 60 is rotated by the operation of the winch 6 to pull the wires 67 so that the entire extended lengths of the wires are shortened. The lengths of the wires 67 are contracted between the middle masts 12 and fixing masts 10, between the upper masts 13 and the middle masts 12, and between the movable masts 15 and the upper masts 13.

However, inasmuch as the engaging portion 25 of the stop lever 22 in each stopper mechanism 19 is engaged with the stopper 26, the middle masts 12 and upper masts 13 are fixedly connected with each other so that the upper masts 13 do not raise upward even if the wires 67 are wound around the pulleys. Likewise, inasmuch as the engaging portion 25 of the stop lever 22 in each stopper mechanism 18 is engaged with the stopper 26, the fixing masts 10 and middle masts 12 are fixedly connected with each other so that the upper masts 12 do not raise upward even if the wires 67 are wound around the pulleys.

Accordingly, the movable masts 15 alone are initially moved upward by the winding force of the wires 67. The movable masts 15 are slidably moved upwardly along the guide portions 13-A of the upper masts 13 and at the same time the platform 16 is moved upward which enables movement of operators and materials loaded thereon upward. As a result, the platform 16 is raised from the state where it is positioned in its lowermost position (FIG. 2) to position adjacent to the upper ends of the upper masts 13. Successively, the platform 16 is kept raised until the releasing member 27 of each stopper mechanism 19 approaches the stop lever 22.

As the lower end of mast 15 reaches a position adjacent the upper end of mast 13, the operating surface 28 of release member 27 as mounted on mast 15 contacts the operating portion 24 of lever 22 mounted on mast 13, thereby turning the operating portion 24 and lever 22 counterclockwise against the resiliency of the spring 23 so that the engaging hook portion 25 is disengaged from the stopper 26 mounted on the mast 12. The upper masts 13 are thus disconnected from the middle masts 12 and then raised upward relative to the middle masts 12 by further winding of the wires 67 onto the drum 60.

The locking mechanisms 30 start to operate (i.e. engage) at the same time as the stopper mechanisms 19 connected between the upper masts 13 and the middle masts 12 are disconnected.

That is, the locking pin portion 32 approaches the engaging portion 31 at the same time as the operating surface 28 of stopper mechanism 19 contacts the respective operating lever portion 24, so that the locking pin 53 contacts the cam surface 45 and rides along the guide surface 37 and is guided to the guide groove 35. The locking pin 53 is always biased by the coil spring 56 by way of the holding plate 54, and hence the locking pin 53 is engaged inside the guide groove 35 and pressed into the C-shaped inside space of the shaft fitting 34.

When the movable masts 15 are further raised upward to the state where the locking pin 53 is fully engaged with the shaft fitting 34, the locking pin 53 then raises the hooked portion 36 whereby the movable masts 15 and the upper masts 13 are engaged with each other. Thereafter, additional upward lifting of masts 13 and 15 causes the operating plate 41 respectively contacting the upper end of the middle mast 12 to be moved upwardly and disengaged from the mast 12 so that the rod 40 is pulled downward by the spring 42 and at the same time the C-shaped closable fitting 38 is turned by arm 39 to close the opening of the introduction groove 35. Accordingly, the locking pin 53 is fixedly connected to the shaft fitting 34, being locked therein by the closable fitting 38.

In such a way, the movable masts 15 and the upper masts 13 are fixedly connected by the locking mechanisms 30 so that the movable masts 15, the upper masts 13 and the locking mechanisms 30 are raised at the same time as a fixed structure. Hence, the upper masts 13 and the movable masts 15 are raised further by the wires 67 so that the platform 16 is raised further upward. When the upper masts 13 are raised and the lower portions of the upper masts 13 approach a position adjacent to the upper ends of the middle masts 12, the stopper mechanisms 18 are operated in the same way as in the operation described just above and the middle masts 12 are disengaged from the fixing masts 10. At the same time, the locking mechanisms 30 are operated for connecting the lower portions of the upper masts 13 with the upper portions of the middle masts 12 so that the upper masts 12 and the middle masts 13 are now also fixedly connected with each other.

When the wires 67 are successively wound by the winding drum 60, the middle masts 12 raise relative to the fixing masts 10 so that the platform 16 is further raised upward.

With such series of operations, the movable masts 15 alone are first raised, then the upper masts 13 and the movable masts 15 are fixedly connected with each other and the upper masts 15 are raised further upward. Thereafter, the upper masts 13 reach the upper ends of the middle masts 12, at which position the upper masts 13 and the middle masts 12 are also fixedly connected with each other, and then the middle masts 12 are raised. Successively, the platform 16 can be raised to a high elevated location.

The lowering operation of the platform 16 will be described hereinafter.

The motor for driving the winch 6 is reversely rotated for unwinding the wires 67 from the wiring drum 60. Then, each wire 67 is slackened to lengthen the length between each pair of pulleys 62 and 63 due to the weight of the platform 16, and hence each middle mast 12 is lowered relative to the respective fixing mast 10. When the entire length of the middle mast 12 is lowered to the fixing position of the respective fixing mast 10, the operation plate 41 of the engaging portion 31 mounted on the upper end of each mast 12 contacts the upper end of the respectively adjacent fixing mast 10 so that the arm 39 is pulled upward against the resiliency of the coil spring 42 to reversely rotate the closable fitting 38. The reversed rotation of the closable fitting 38 causes the position of the C-shaped opening to align with the position of the introduction groove 35 so that the locking pin 53 on mast 13 is released. As a result, the locking pin 53 can be lowered freely by contacting the introduction surface 37 and the cam surface 44.

At the same time, the operating surface 28 on the releasing member 27 in the stopper mechanism 18 is moved downwardly away from the operating lever portion 24 so that the stop lever 22 is turned clockwise in FIG. 7 by the spring 23 and the engaging portion 25 moves under the lower surface of the stopper 26. Accordingly, the fixing mast 10 is now fixedly connected with the respectively adjacent middle mast 12, whereby both of the fixing masts 10 and the middle masts 12 are fixed at the same lowered positions.

When the wire 67 is further slackened, each upper mast 13 is lowered relative to its respective middle mast 12. When the masts 13 approach the fully lowered portion, the locking mechanisms 30 between the upper ends of masts 13 and the lower ends of masts 15 are released in the same way as described hereinbefore, whereby the upper masts 13 are disconnected from the movable masts 15. The stopper mechanisms 19 are also operated at the same time, and the lowered upper masts 13 are fixedly connected to the middle masts 12. In such a manner, the fixing masts 10, the middle masts 12 and the upper masts 13 are respectively fixed at the same height (i.e., the fully lowered position), while the movable masts 15 are kept positioned at a higher position. Hence, if the wire 67 is further slackened, the movable masts 15 are guided downwardly along the grooves of the upper masts 13 so that the platform 16 is further lowered to reach its lowermost position closely adjacent the upper surface of the chassis 1.

With the series of successive operations, the platform 16 can be raised to the uppermost position and lowered to the lowest position.

With such an arrangement of the lifting apparatus according to the first embodiment, the following effects can be obtained.

It is possible to connect the mast with other masts successively or disconnect the mast from other masts for raising or lowering the platform in the mechanism assembled by a plurality of stretchable mast assemblies.

It is possible to raise the platform firmly and safely since the plurality of mast assemblies can be raised as a whole by the successive operations of connection and disconnection of the plurality of masts. Even if the mechanism employs the wire for raising the platform, the safety is improved.

Second Embodiment (FIGS. 11 to 17)

A lifting apparatus according to a second embodiment will be described with reference to FIGS. 11 to 17.

The arrangement of the lifting apparatus according to the second embodiment is the same as that of the first embodiment except for the mast fixing mechanism. Hence, the mast fixing mechanism and the operation thereof are described hereinafter.

Figure 11:
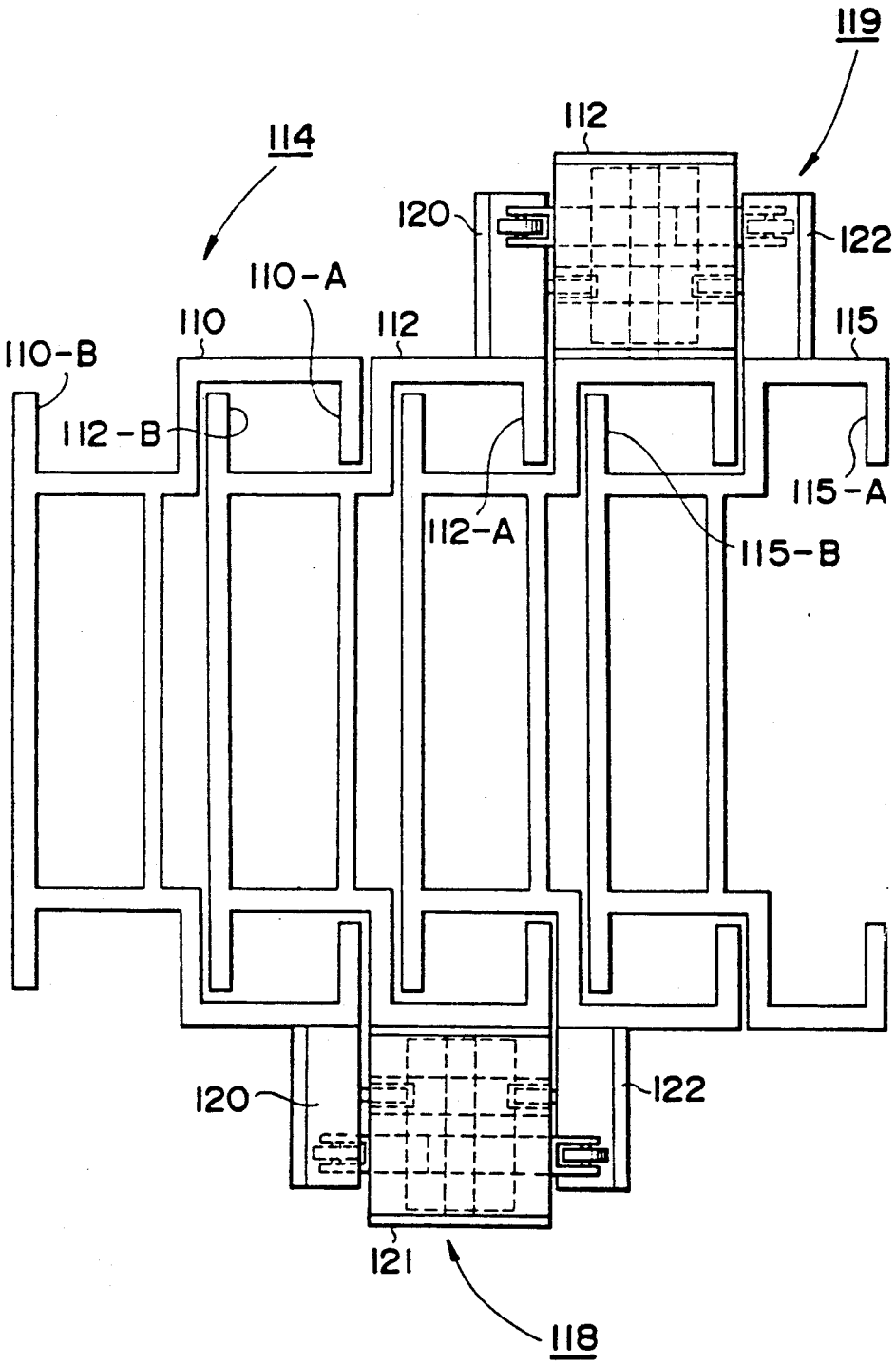
FIG. 11 is a cross sectional view showing a combination of stretchable masts for the lifting mechanism according to a second embodiment of the invention.

FIG. 11 is a cross sectional view for explaining an assembly of masts 110, 112, 113 and 115 constituting the stretchable mast assembly 114.

Fixing masts 110, middle masts 112, upper masts 113 and movable masts 115 are the same in cross section thereof and are manufactured by subjecting aluminum alloy and the like to a drawing process. The fixing masts 110, the middle masts 112, the upper masts 113 and the movable masts 115 respectively have guide portions 110-A, 112-A, 113-A, 115-A formed by bending both ends of the one side surfaces thereof (inner surfaces of the opposed masts) inward in an L-shape to form a U-shaped space. There are defined flat shaped sliding portions 110-B, 112-B, 113-B, 115-B at the other side surfaces thereof (outer surfaces). The slider portions 112-B of the middle masts 112 are inserted into a space of the guide portions 110-A of the fixing masts 110 while the slider portions 113-B of the upper masts 113 are inserted into a space of the guide portions 112-A of the middle masts 112. The slider portions 115-B of the movable masts 115 are inserted into a space of the guide portions 113-A of the upper masts.

In such an assembly of these masts, the middle masts 112 are slidable vertically relative to the fixing masts 110, the upper masts 113 are slidable vertically relative to the middle masts 112, and the movable masts 115 are slidable vertically relative to the upper masts 113. First stopper mechanisms 118 are fixed to the middle masts 112 at upper ends of both sides thereof while second stopper mechanisms 119 are fixed to the upper masts 113 at upper ends of both sides thereof. The arrangement of the first stopper mechanisms 118 are substantially the same as that of the second stopper mechanism 119 and respectively constitute the mast fixing mechanism.

Figure 12:
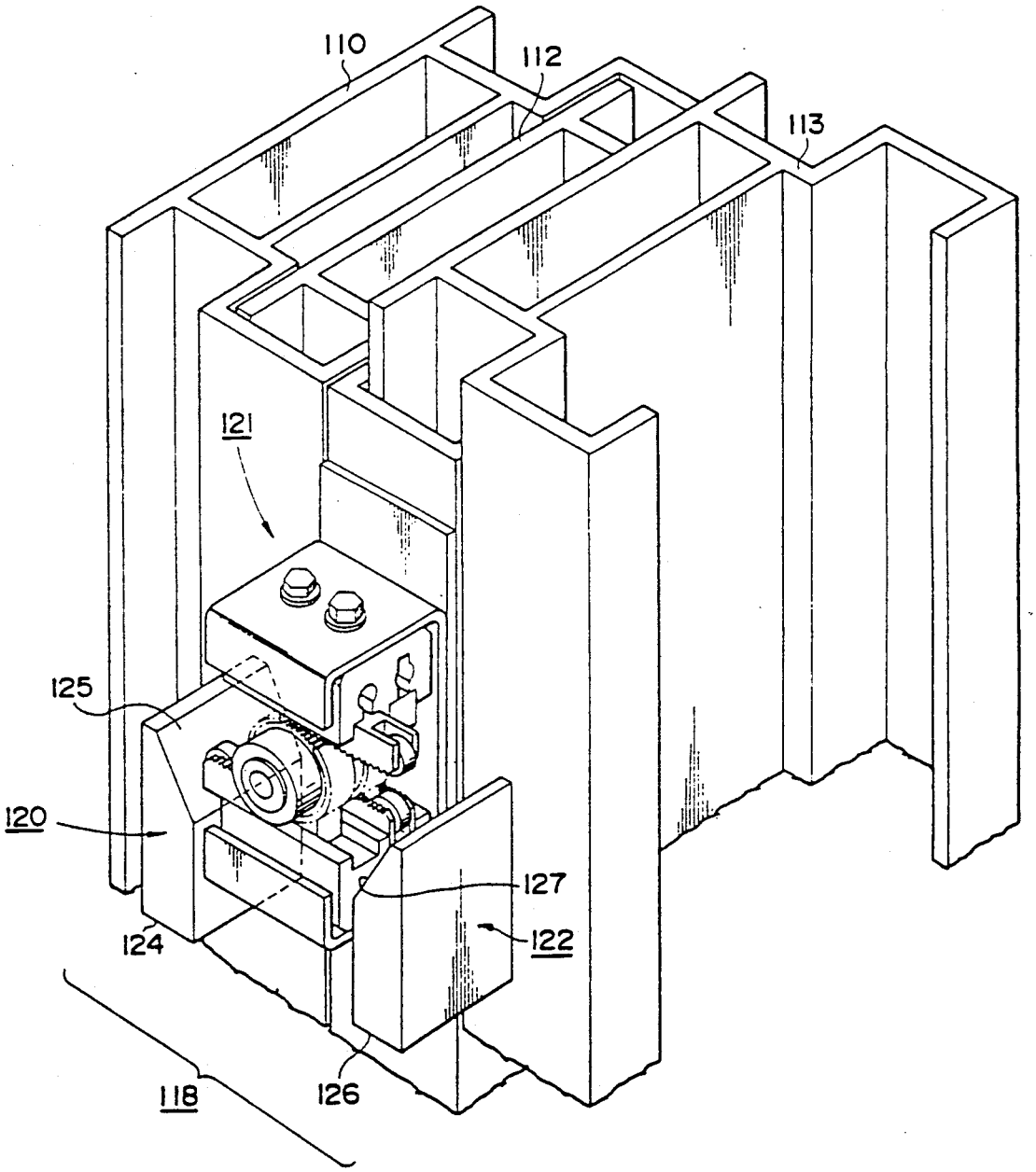
FIG. 12 is an enlarged perspective view showing an arrangement of a mast fixing mechanism for the lifting apparatus according to the second embodiment of the invention.
Figure 13:
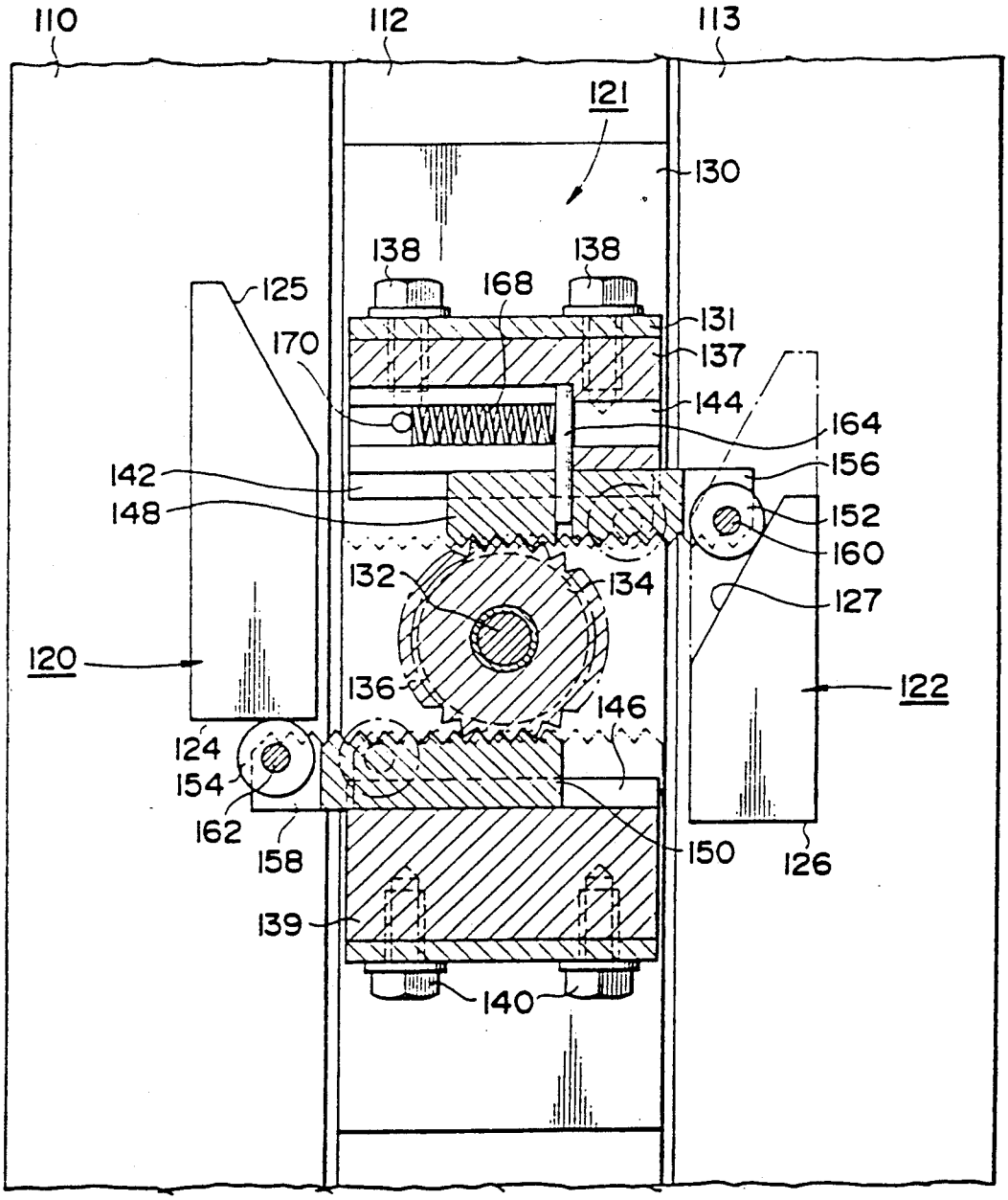
FIG. 13 is a side view of FIG. 12 in which the mast fixing mechanism is partially cut away.
Figure 14:
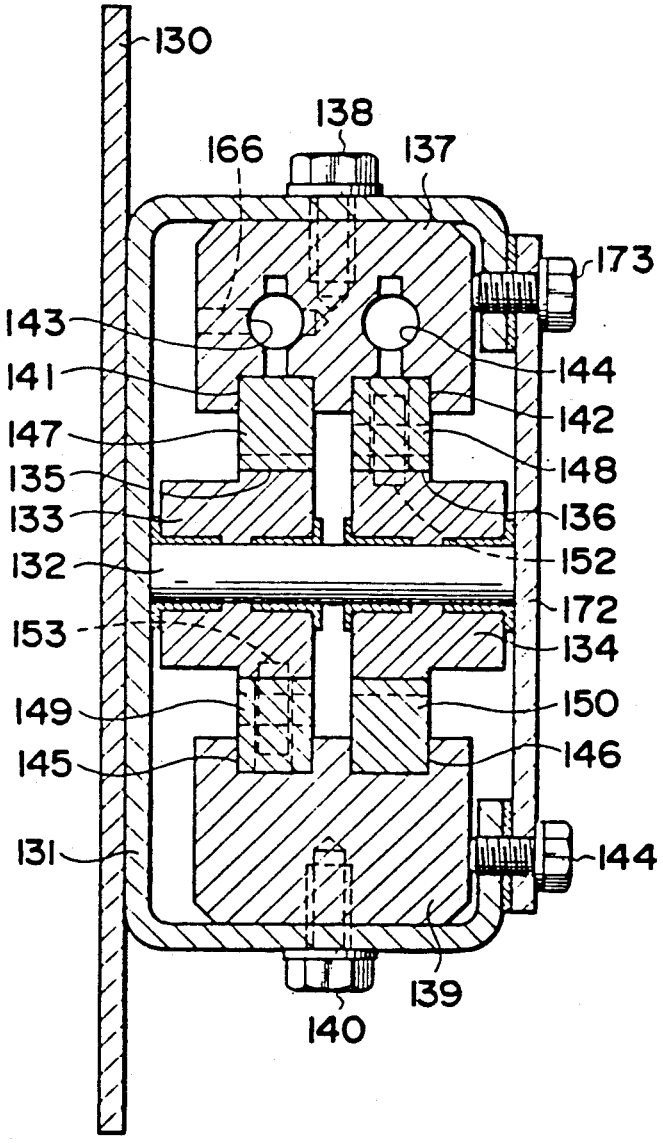
FIG. 14 is a cross sectional view showing the state where an engagement unit of the mast fixing mechanism of FIG. 12 is cut away vertically.
Figure 15:
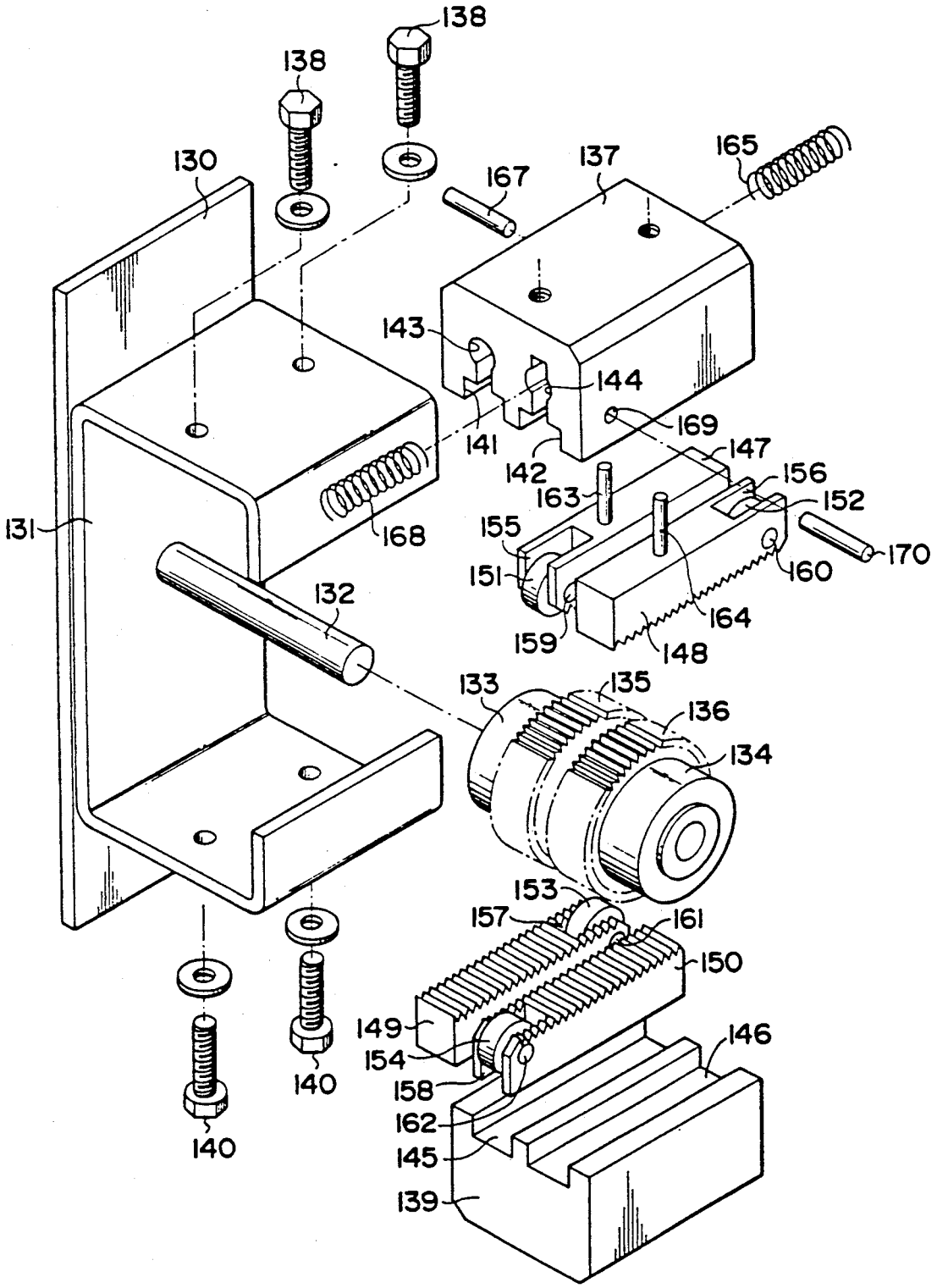
FIG. 15 is an exploded perspective view of the engagement unit of FIG. 14.

The first stopper mechanisms 118 are exemplarily illustrated in FIGS. 12 to 15 as the mast fixing mechanism. FIG. 12 shows a fixing state of the mast fixing mechanism, FIG. 13 is a longitudinal cross sectional view thereof, FIG. 14 is a side cross sectional view thereof, and FIG. 15 is an exploded view showing constituents thereof.

A stopping block 120 as a stopping means is fixed to the upper side portion of the fixing mast 110 and an engaging unit 121 as a selective engaging means is fixed to the upper side surface of the middle masts 112. A control block 122 as a locking releasing means is fixed to the lower side surface of the upper mast 113. In FIG. 12, although the stopping block 120, the engaging unit 121 and the control block 122 are placed in the same horizontal surface for convenience of explanation, the engaging unit 121 is not positioned over the stopping block 120 and the control block 122 in the practical use.

The stopping block 120 is rectangular as a whole and has a lower portion for forming a horizontal stopping surface 124 and an upper portion cut off aslant for forming an inclined surface 125 which is directed toward the engaging unit 121. The control block 122 has the same configuration as that of the stopping block 120, i.e. has a lower surface for forming a horizontal stopping surface 126 and an upper portion cut off aslant for forming an inclined surface 127 which is directed toward the engaging unit 121.

The engaging unit 121 will be described more in detail with reference to FIGS. 13 to 15.

The engaging unit 121 is selectively engageable with the stopping block 121 or the control block 122 for controlling the vertical sliding of the middle mast 112.

The engaging unit 121 has a base plate 130 which is fixed to the side surface of the middle mast 112. A holding frame 131 formed by bending a thin steel plate in substantially a U-shape is fixed to the central portion of the base plate 130 and has an opening oriented in the side direction. A shaft 132 is fixed to the central portion of the holding frame 131 at right angle relative to the base plate 130 and has a tip end positioned at the central portion of the opening of the holding frame 131. Two collars 133 and 134 are rotatably inserted unto the shaft 132. The collar 133 has a pinion 135 at the periphery thereof and the collar 134 has a pinion 136 at the periphery thereof.

A block-shaped guide body 137 is disposed in an upper space of the holding frame 131 and brought into contact with an upper portion of the holding frame 131. The guide body 137 is fixed to the upper portion of the holding frame 131 by screws 138. A block-shaped guide body 139 is inserted into a lower space of the holding frame 131 and fixed to the lower portion of the holding frame 131 by screws 140. Neither a lower surface of the guide body 137 nor an upper surface of the guide body 139 contact the pinions 135 and 136. The lower surface of the guide body 137 is cut to define long and narrow grooves 141 and 142 at right angles with the shaft 132. The upper surfaces of the guide grooves 141 and 142 are cut to define spring holes 143 and 144 respectively having circular shapes in cross section and positioned in parallel with the guide grooves 141 and 142. There are defined gourd-shaped spaces by the guide grooves 141 and 142 and the spring holes 143 and 144 when viewed from the side surface (refer to FIG. 14) which gourd-shaped spaces penetrate from one side surface of the guide body 137 to the other side of the guide body 137. The upper surface of the guide body 139 is cut to define guide grooves 145 and 146 at right angle relative to the shaft 132.

A rectangular rack 147 having teeth at the lower surface thereof is slidably inserted into the guide groove 141. The teeth of the rack 147 are engaged with the pinion 135. Likewise, a rectangular rack 148 having teeth at the lower surface thereof is slidably inserted into the guide groove 142. The teeth of the rack 148 are engaged with the pinion 136. Rectangular racks 149 and 150 having teeth at the upper surfaces thereof are slidably inserted into the guide grooves 145 and 146, respectively. The teeth of racks 149 and 150 are respectively engaged with the pinions 135 and 136. With such an arrangement, when the pinion 135 is rotated, the racks 147 and 149 are respectively moved in opposite directions. Likewise, when the pinion 136 is rotated, the racks 148 and 150 are respectively moved in opposite directions.

In FIG. 15, a roller 151 is supported by a pin 159 provided at a groove 155 defined at the left side of the rack 147 while a roller 152 is supported by a pin 160 provided at a groove 156 defined at the right side of the rack 148. A roller 153 is supported by a pin 161 provided at a groove 157 defined at the right side of the rack 149 while a roller 154 is supported by a pin 162 provided at a groove 158 defined at the left side of the rack 150.

Pin-shaped operation pins 163 and 164 are protruded from central portions of the upper surfaces of the racks 147 and 148 perpendicular relative to the upper surfaces thereof. The operation pin 163 is housed in the spring hole 143 to be moved inside thereof while the operation pin 164 is housed in the spring hole 144 to be moved inside thereof. There is inserted a coil-shaped spring 165 into the spring hole 143 from the right side in FIG. 15 wherein one end of the spring 165 contacts the operation pin 163 and the other end of the spring 165 contacts a spring presser 167 inserted into a pin hole 166 defined at right angle relative to the spring hole 143. Since the other end or the terminal of the spring 165 contacts the spring presser 167, the spring 165 always urges the operation pin 163 and the rack 147 leftward in FIG. 15. There is inserted a coil-shaped spring 168 into the spring hole 144 from the left side in FIG. 15 wherein one end of the spring 168 contacts the operation pin 164 and the other end of the spring 168 contacts a spring presser 170 inserted into a pin hole 169 defined at right angle relative to the spring hole 144. Since the other end or the terminal of the spring 168 contacts the spring presser 170, the spring 168 always urges the operation pin 164 and the rack 148 rightward in FIG. 15. When all the constituents as illustrated in FIG. 15 are assembled, a flat shaped closable plate 172 as shown in FIG. 14 is brought into contact with upper and lower end surfaces of the holding frame 131 and fixed thereto by screws 173 and 174.

Figure 16:
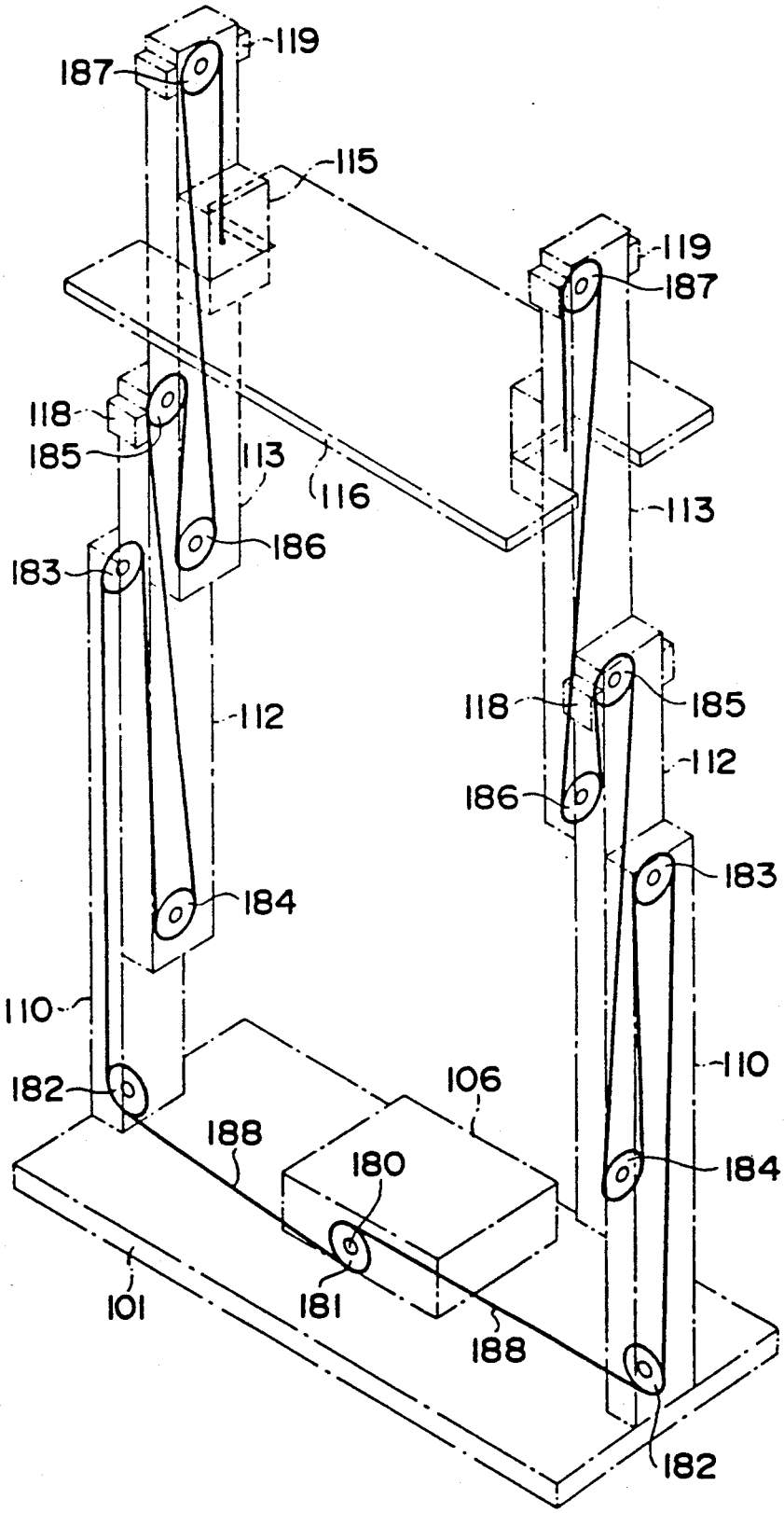
FIG. 16 is a view for explaining the state of winding of a control wire for the lifting mechanism according to the second embodiment of the invention.

A winding operation of the lifting wire employed in the second embodiment will be described with reference to FIG. 16. In the same figures, the fixing mast 110, the middle mast 112, the upper mast 113 and the movable mast 115 are shifted for convenience of explanation, but such will not be affected practically.

An operation shaft 180 protrudes from a side surface of a winch 106 and is fixed to a winding drum 181. Pulleys 182 and 183 are respectively rotatably provided at the lower and upper portions of the fixing masts 110, pulleys 184 and 185 are rotatably provided at the lower and upper portions of the middle masts 112 and pulleys 186 and 187 are rotatably provided at the lower and upper portions of the upper masts 113. A lifting control wire or cable 188 is wound around the winding drum 181 and further wound around successively the pulleys 182, 183, 184, 185, 186 and 187 so as to form S-shapes respectively. An end of the wire 188 is connected to the respective movable mast 115. In such manner, one wire 188 is wound around the pulleys respectively provided at the lower and upper portions of the masts 110, 112 and 113.

An operation of the lifting apparatus according to the second embodiment will be described hereinafter.

Described first of all is a case where the lifting apparatus is to be moved to the working site. The middle masts 112, the upper masts 113 and the movable masts 115 are respectively lowered which involves the contraction of the height of the lifting apparatus as a whole. In this state, it is possible to rollingly move the lifting apparatus with very light force. When the chassis 101 is moved to the working site, the chassis 101 is temporarily fixed at the working site in the same manner as in the first embodiment. Hence, the explanation thereof is omitted.

Successively, the platform 116 is raised by operating the winch 106 so that the wires 188 are wound around the winding drum 181. The winding drum 181 is rotated by the operation of the winch 106 to pull the wires 188 so that the extended entire lengths of the wires are shortened. Then, the mast assemblies are operated in the manner that the length of the wires 188 wound around the pulleys 185 of the middle masts 112 are contacted relative to the pulleys 183 of the fixing masts 110, the wires as wound around the pulleys 187 of the upper masts 113 relative to the pulleys 185 of the middle masts 112, and the ones fixed to the movable masts 115 relative to the upper masts 113, are respectively contracted. However, since the mast fixing mechanisms 119 are fixed to the side surfaces of the upper masts 113 and the middle masts 112, the wires 188 first raise the movable masts 115 alone so that the movable masts 115 move upwardly to contact the upper ends of the upper masts 113.

Then, the lower portions of the movable masts 115 contact the fixing mechanisms 119 so that the mast fixing mechanisms 119 are released. Accordingly, the upper masts 113 can slide upwardly relative to the middle masts 112 and the movable masts 115 and the upper masts 113 are moved upward simultaneously. When the lower portions of the upper masts 113 move to positions adjacent to the upper ends of the middle masts 112, the lower portions of the upper masts 113 release the mast fixing mechanisms 118 for allowing the middle masts 112 to release relative to the fixing masts 110 so that the middle masts 112 can move freely relative to the fixing masts 110. Then, the middle masts 112 raise together with the movable masts 115 and the upper masts 113, thereby raising the platform 116 further upwardly.

These operations can be effected successively by winding the wires 188 and the control for sliding operations of the masts 110, 112, 113 and 115 is switched in turn by the mast fixing mechanisms 118 and 119. Observation of the series of operations reveal that the movable masts 115, the upper masts 113 and the middle masts 112 are successively extended in this order from the fixing masts 110. The mast fixing mechanisms provide control to prevent each of the masts 112, 113 and 115 from moving arbitrarily. Hence, the platform 116 is raised while it is always kept parallel with the chassis 101.

Figure 17A:
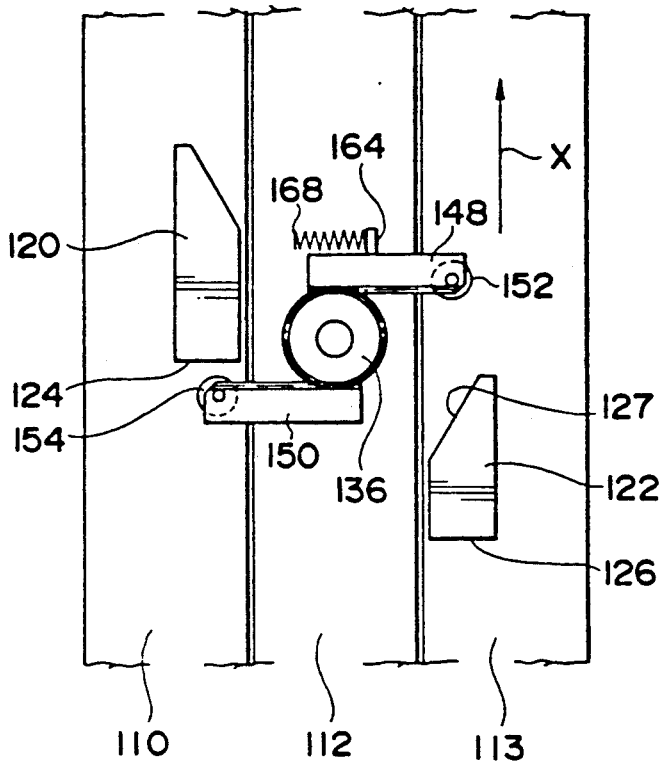
FIGS. 17(A) to 17(F) are views for explaining the operation of the lifting mechanism according to the second embodiment of the invention.
Figure 17B:
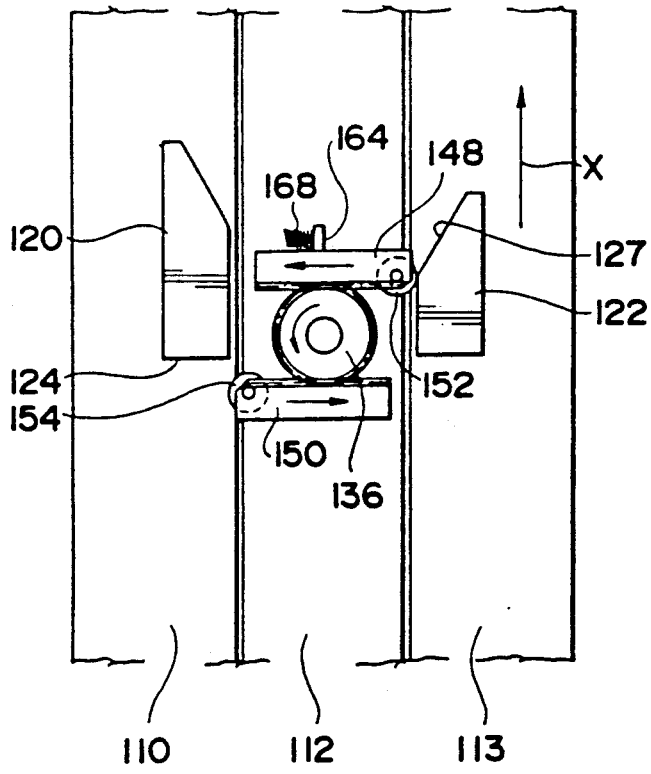
Figure 17C:
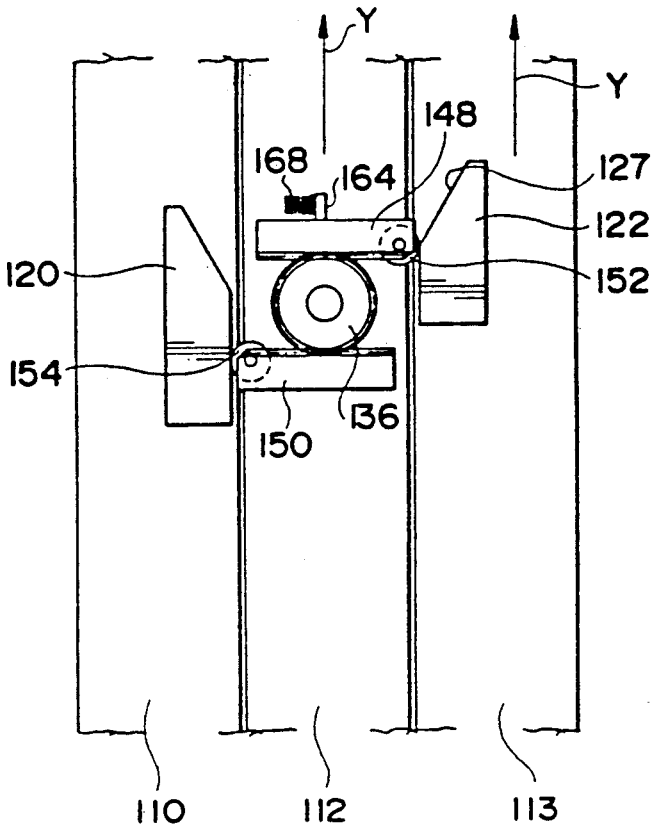
Figure 17D:
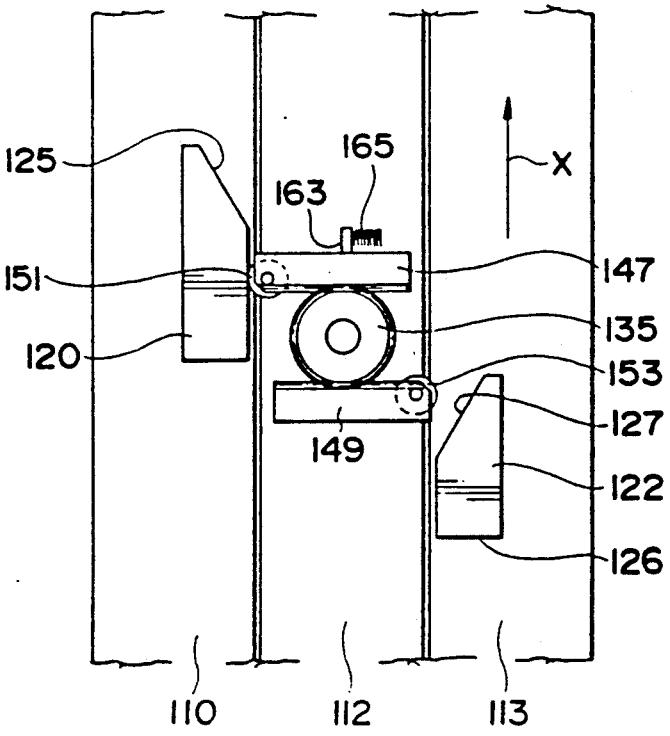
Figure 17E:
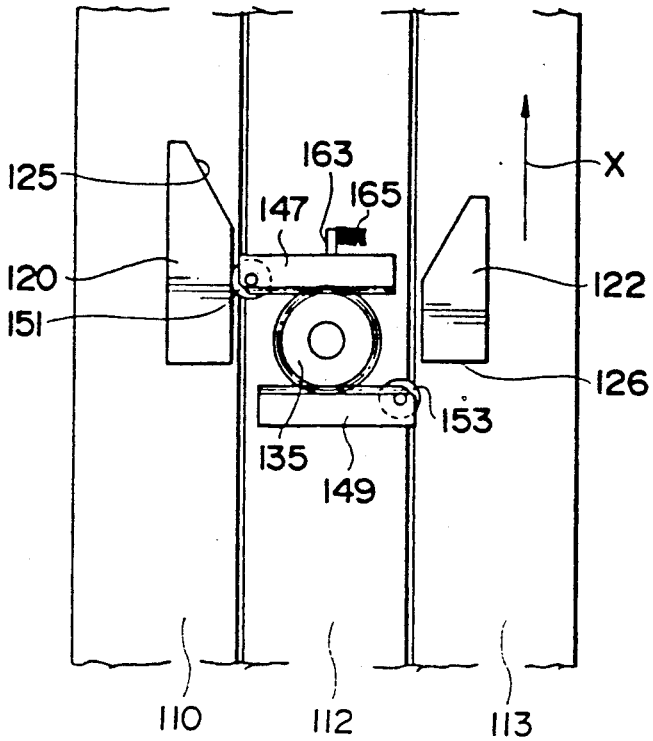
Figure 17F:
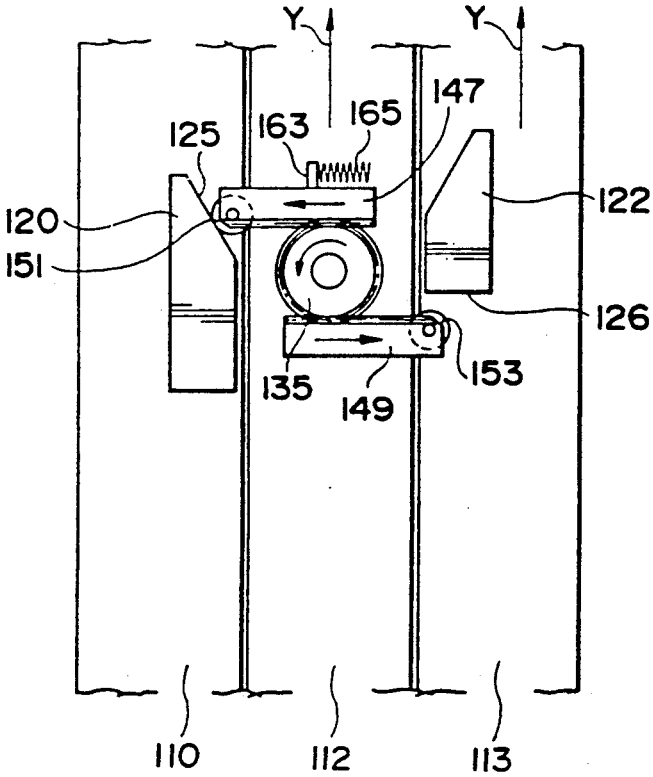

FIGS. 17(A) through 17(F) are views showing operations of the fixing mechanisms 118 and 119 for controlling movement of the middle masts 12, the upper masts 13 and the movable masts 15 relative to the fixing masts 10. FIGS. 17(A), 17(B) and 17(C) show the state where the mast fixing mechanisms 118 are transversely cut through the pinion 136 and the racks 148 and 150, while FIGS. 17(D), 17(E) and 17(F) show the state where the mast fixing mechanisms 118 are transversely cut through the pinion 135 and the racks 147 and 149.

The mast fixing mechanisms 118 as illustrated in FIGS. 17(A), 17(B) and 17(C) correspond to and are operated at the same time as those shown in FIGS. 17(D), 17(E) and 17(F) respectively. The mast mechanisms 118 are unfixed or unlocked in the order of FIGS. 17(A), 17(B) and 17(C), whereas the middle masts 112 and the upper masts 113 are fixed or locked in the order of FIGS. 17(A), 17(B) and 17(C).

FIGS. 17(A) and 17(D) show the state where the wire 188 is pulled and only the upper mast 113 is moved in the direction of the arrow X. In this state, the operation pin 164 is pushed rightward by the spring 168 and the rack 148 is also pushed, hence the rack 150 protrudes toward the fixing mast 110 while the rollers 152 and 154 are respectively protruded toward the side surfaces of the middle mast 112. Accordingly, the roller 154 contacts the stopping surface of the stopping block 120 and the rack 150 is blocked by the stopping block 120, whereby the middle mast 112 cannot move upward relative to the fixing mast 110. At the same time, however, the spring 165 pushes the operation pin 163 so that the rack 147 is biased leftward as shown in FIG. 17(D). However, the roller 151 contacts the side surface of the stopping block 120 and the rack 147 does not protrude from the side surface of the middle mast 112. Accordingly, the rack 149 opposite to the rack 147 does not protrude at its end from the side surface of the middle mast 112 and the roller 153 is positioned inside the side surface of the upper mast 113.

FIGS. 17(B) and 17(E) show the state where the upper mast 113 is gradually raised in the direction of the arrow X and the control block 122 contacts the roller 152. When the inclined surface 127 of the control block 122 contacts the roller 152, the roller 152 and the rack 148 are pushed leftward in FIG. 17(B) to rotate the pinion 136 counterclockwise while compressing the spring 168, thereby moving the rack 150 rightward in FIG. 17(B). Then, the roller 154 is pulled from below the stopping surface 124 of the stopping block 120 so that the engagement between the stopping block 120 and the roller 154 is released. Hence, the middle mast 112 is disengaged from the fixing mast 110 so that it can be freely vertically moved. When the rack 148 is pushed by the control block 122 rightward in FIG. 17(B), the stopping surface 126 of the control block 122 is positioned above the height of the roller 153 on rack 149.

FIGS. 17(C) and 17(F) show the state where the stopping surface of the stopping block 120 is disengaged from the roller 154 and the upper mast 113 and the middle mast 112 are moved simultaneously in the direction of the arrow Y. This is caused by the movement of the middle mast 112 together with the upper mast 112 since the upper mast 113 is further pulled by the wire 188. Since the roller 152 is already pushed by the inclined surface 127, the racks 148 and 150 are not moved further and the pinion is not rotated. However, when the middle mast 112 is moved upward, the contact position of the roller 151 of the rack 147 is moved upward. When the roller 151 contacts the inclined surface 125 of the stopping block 120, the spring 165 pushes the operation pin 163 so that the rack 147 is moved along the inclined surface 125 in the direction of the arrow in FIG. 17(F). The movement is transmitted to the pinion 135, thereby pushing the rack 149 rightward in FIG. 17(E) so that the roller 153 protrudes to the large extent from the side surface of the middle mast 112 and is positioned under the stopping surface 126 of the control block 122 in FIG. 17(F). Accordingly, when the middle mast 112 is further moved upward, the roler 153 contacts the stopping surface 126 and the middle mast 112 and the upper mast 113 are raised upward at the same time.

With the successive operations in the order of FIGS. 17(A), 17(B) and 17(C), the control block 122 contacts and pushes the roller 152 to move the rack 148 so that the middle mast 112 is disengaged from the fixing mast 110 and moved freely upward. Since the rack 148 protrudes at the same time, the roller 153 contacts the stopping surface 126 so that the middle mast 112 is engaged with the upper mast 113 and moved upward together with the upper mast 113.

When the drum 181 is reversely rotated, the wire 188 is slackened so that both the upper mast 113 and the middle mast 112 are simultaneously lowered opposite to the operation set forth above. That is, the upper mast 113 alone is not lowered but both the upper mast 113 and the middle mast 112 are lowered at the same time since the roller 153 contacts the stopping surface 126. Contrary to the operation set forth above, the upper mast 113 is then disengaged from the middle mast 112 and at the same time the middle mast 112 is stationarily engaged with the fixing mast 110 due to mast 112 having been fully lowered. Hence, the upper mast 113 alone is then moved freely relative to the middle mast 112 and the upper mast 113 alone is lowered.

Figure 18:
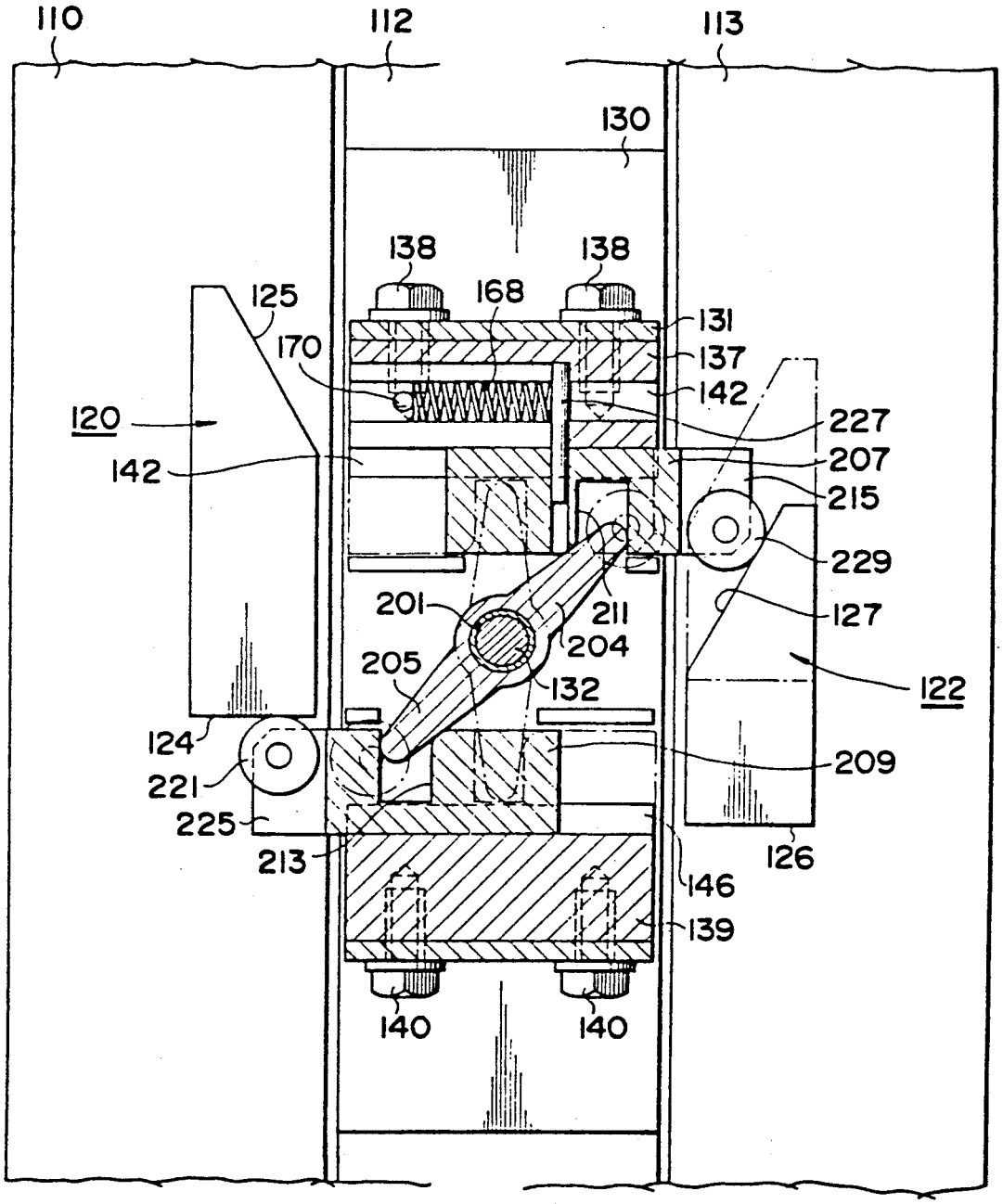
FIG. 18 is a cross sectional view showing the state where a mast fixing mechanism according to a third embodiment of the present invention is partially cut away.
Figure 19:
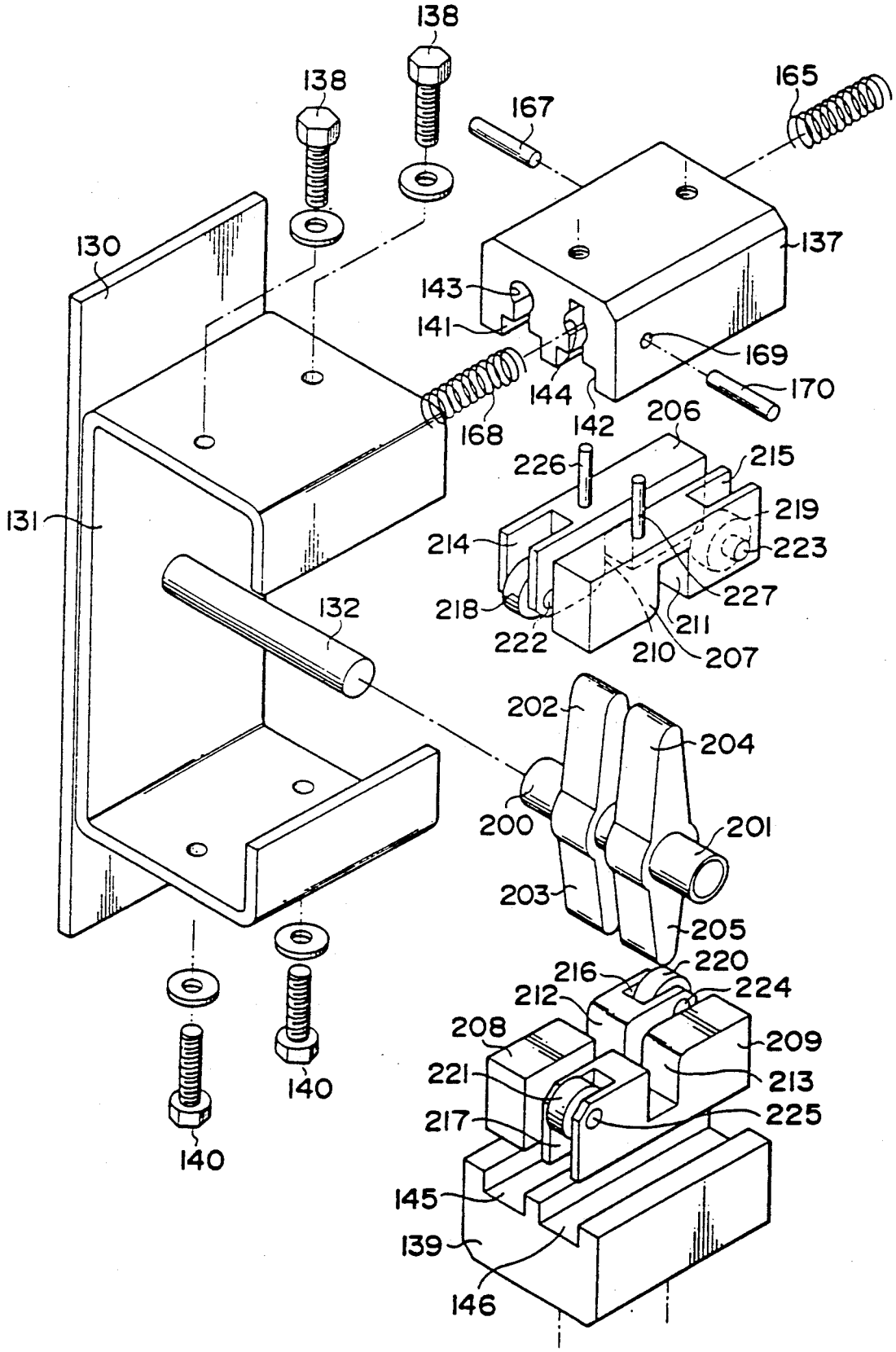
FIG. 19 is an exploded perspective view of an engagement unit in the mast fixing mechanism of FIG. 18.

Third Embodiment (FIGS. 18 and 19)

A lifting apparatus according to a third embodiment will be described with reference to FIGS. 18 and 19.

The arrangement of the lifting apparatus according to the third embodiment is the same as that of the second embodiment except for the mast fixing mechanism. Hence, the mast fixing mechanism and the operation thereof are described hereinafter.

Two collars 200 and 201 are inserted unto the shaft 132. The collar 200 has a blade 202 at one side and a blade 203 at the other side opposite to the blade 202. The collar 201 has a blade 204 at one side and a blade 205 at the other side opposite to the blade 204. These blades 202, 203, 204 and 205 are tapered toward the tip ends thereof and shaped like butterflies.

Block-shaped sliding bodies 206 and 207 are inserted into the guide grooves 141 and 142 defined in the guide body 137 while block-shaped sliding bodies 208 and 209 are inserted into guide grooves 145 and 146 defined in the guide body 139. The sliding bodies 206 and 207 have downwardly recessed engaging grooves 210 and 211 at the central lower surfaces thereof. The engaging groove 210 is engaged by the tip of blade 202 while the engaging groove 211 is engaged by the tip of blade 204. The sliding bodies 208 and 209 have upwardly recessed engaging grooves 212 and 213 at the central lower surfaces thereof. The engaging groove 212 is engaged by the tip of blade 203 while the engaging groove 213 is engaged by the tip of blade 205. With such an arrangement, when the collar 200 is rotated, the sliding bodies 206 and 208 are slid in opposite directions, i.e. left and right directions by the blades 202 and 203. Similarly, when the collar 201 is rotated, the sliding bodies 207 and 209 are slid in opposite directions, i.e. left and right directions by the blades 204 and 205. There are roller grooves 214 and 217 defined by cutting left sides of the sliding bodies 206 and 209 in FIG. 19, while there are roller grooves 215 and 216 defined by cutting right sides of the sliding bodies 207 and 208 in FIG. 19. Rollers 218 and 219 are accommodated in the roller grooves 214 and 215 and rotatably supported by pins 222 and 223, while rollers 220 and 221 are accommodated in the roller grooves 216 and 217 and rotatably supported by pins 224 and 225. An operation pin 226 is protruded from and fixed to the central upper surface of the sliding bodies 206 while an operation pin 227 is protruded from and fixed to the central upper surface of the sliding bodies 207.

The operation of the third embodiment will be described hereinafter. The upper mast 113 is raised, in the same way as in the second embodiment, whereby the control block 122 is raised so that the inclined surface 127 of the control block 122 contacts the roller 219. Then, the roller 219 and the sliding body 207 are pushed leftward in FIG. 18. Successively, the blade 204 engaged with the engaging groove 211 is rotated counterclockwise in FIG. 18 so that the blade 205 opposite to the blade 204 pushes the engaging groove 213. Accordingly, the sliding body 209 slides rightward in FIG. 18 and the roller 221 is disengaged from the engaging surface 124 of the stopping block 120. Since the middle mast 112 is released from the contact with the stopping block 120, the middle mast 112 can be moved upward. Thus, the embodiment of FIGS. 18 and 19 operates in generally the same manner as the second embodiment described above.

Figure 20:
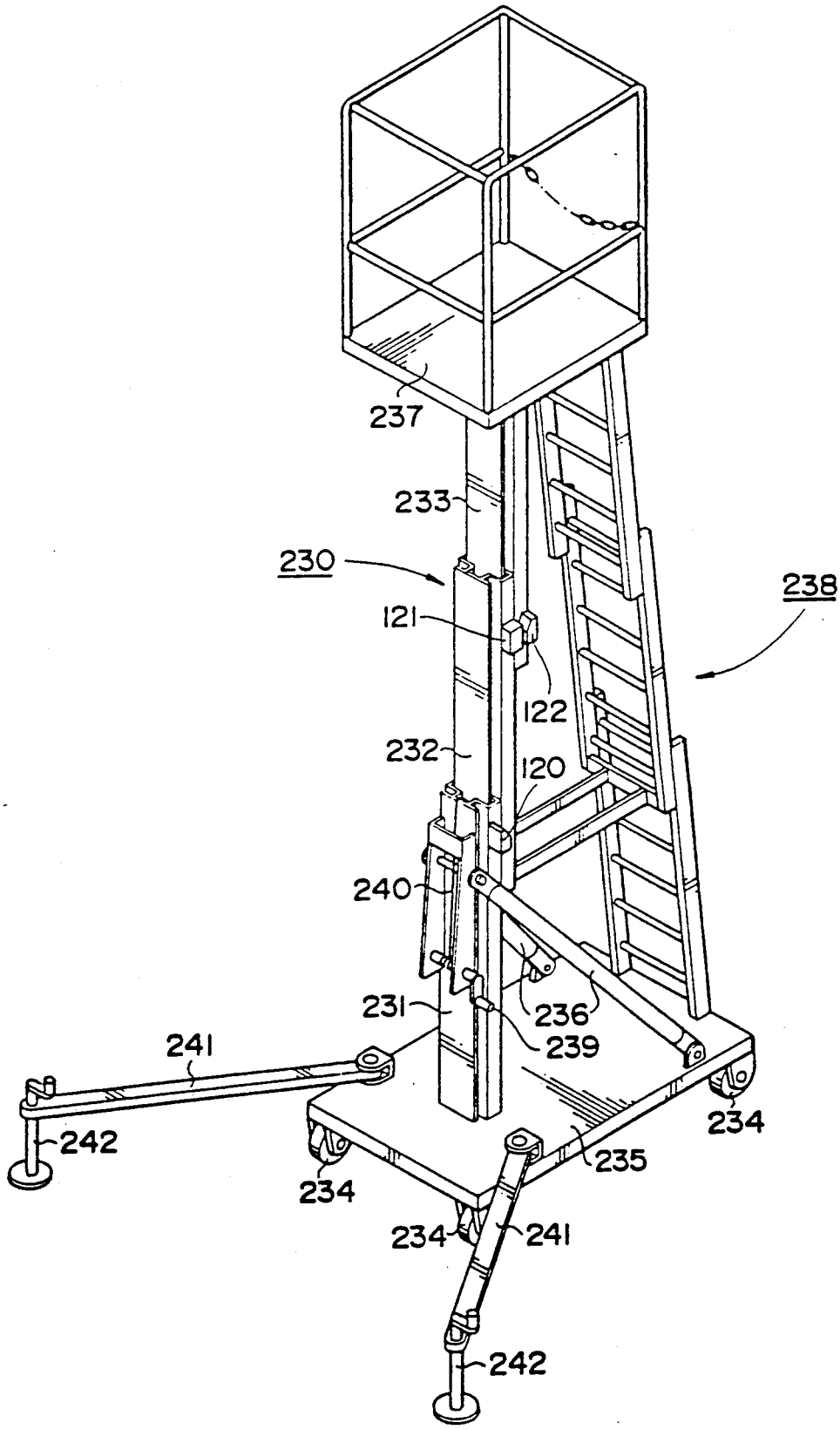
FIG. 20 is a perspective view showing the mast fixing mechanism according to a fourth embodiment which is applied to a lifting apparatus of another type.

Fourth Embodiment (FIG. 20)

A lifting apparatus according to a fourth embodiment will be described with reference to FIG. 20.

According to the fourth embodiment, a mast fixing mechanism is employed in or applied to a lifting apparatus of another kind.

A stretchable mast assembly 230 in this fourth embodiment comprises three members composed of a lower mast 231, a middle mast 232 and an upper mast 233. The lower mast 231 is vertically fixed at the lower end thereof to a chassis 235 having wheels 234 thereunder, and the mast 231 is supported at the upper portion thereof by stays 236 which are widened at the lower portion thereof. The middle mast 232 can move vertically relative to the fixing mast 231. The upper mast 233 can slide vertically relative to the middle mast 232. A square shaped platform 237 is fixedly mounted on an upper end of the upper mast 233. A stretchable ladder 238 is connected between the chassis 235 and the platform 237. The ladder 238 comprises a plurality of ladders and is stretchable vertically. A stopping block 120 is fixed to an upper side surface of the lower mast 231 and an engaging unit 121 (the same as FIGS. 13-15) is fixed to the upper side surface of the middle mast 232 and a control block 122 is fixed to the lower side surface of the upper mast 233.

A crank handle 239 is provided at the rear side of the lower mast 231 for winding a wire 240 around a small cylindrical member. Leg supporters 241 are fixed to the chassis 235 at the rear side thereof and extended like a fan. Fixing legs 242 are fixed to the distal ends of the leg supporters 241 and are movable vertically.

The operation of the fourth embodiment will be described hereinafter. When the handle 239 is rotated, the wire 240 is wound and the upper mast 233 and the middle mast 232 are moved upward, thereby raising the platform 237 in the same arrangement as that illustrated in FIG. 20. At this time, the upper mast 233 is solely first raised, and then the middle mast 232 is disengaged from the fixing mast 231 when the control block 122 contacts the engaging unit 121 so that the upper mast 233 and the middle mast 232 can be raised upward at the same time.

With the arrangement of the lifting apparatus capable of raising the platform by the stretchable mast mechanism composed of an assembly of a plurality of masts according to the second to fourth embodiments, the assembled plurality of masts are raised in turn and a specific mast alone can be raised preferentially. The priority for raising the specific mast can be automatically given for preventing an unspecific mast from raising by the tensile force of the wire.

Inasmuch as the specific mast is first raised among the plurality of masts and remaining masts are sequentially raised in turn thereafter, it is possible to firmly raise the platform with safety. Hence, even if the lifting apparatus employs the mechanism to raise the platform with use of a lifting wire, the raising operation is assured of significant safety.

Although a particular preferred embodiment of the invention has been disclosed in detail for illustrative purposes, it will be recognized that variations or modifications of the disclosed apparatus, including the rearrangement of parts; lie within the scope of the present invention.

I claim:

1. A lifting apparatus comprising:

a base;

a generally horizontally enlarged platform positioned above said base;

a vertically extendable mast assembly connected between said base and said platform for effecting raising and lowering of the platform relative to the base, said mast assembly having a plurality of masts including a vertically elongate first mast which is fixed to said base and projects upwardly therefrom, a vertically elongate second mast which is vertically movably supported on said first mast and is vertically movable from a lowered position adjacent said first mast into a raised position wherein said second mast projects vertically upwardly a significant extent above said first mast, a vertically elongate third mast which is vertically movably supported on said second mast and is vertically movable from a lowered position adjacent said second mast into a raised position wherein said third mast projects vertically upwardly a significant extent above said second mast, and a fourth mast which is vertically movably supported on said third mast for vertical movement between raised and lowered positions relative to said third mast, said fourth mast being fixed to said platform;

lifting means cooperating between said base and said platform for raising and lowering of said platform relative to said base, said lifting means including winding means mounted on the base, pulleys provided at upper and lower ends of each of said first, second and third masts, and cable means wound around said pulleys and having opposite ends thereof connected to the winding means and said fourth mast; and sequencing means cooperating between said plurality of masts for controlling raising of said platform from a fully lowered position to a fully raised position by first causing solely raising of said fourth mast followed by raising of said third and fourth masts as a unit and thereafter followed by raising of said second and third and fourth masts as a unit.

2. A lifting apparatus according to claim 1, wherein said sequencing means includes a first sequencing mechanism cooperating between said first and second masts for fixedly vertically securing said second mast in the lowered position relative to said first mast, and a second sequencing mechanism cooperating between said second and third masts for vertically fixedly securing said third mast in the lowered position relative to said second mast, each of said first and second sequencing mechanisms respectively including first and second release members which are respectively mounted on said third and fourth masts.

3. A lifting apparatus according to claim 2, wherein said first sequencing mechanism includes a first stop mounted on said first mast adjacent an upper end thereof, a first stopper movably mounted on said second mast adjacent an upper end thereof and being engageable with said first stop for preventing raising of said second mast when said second mast is in the lowered position, and said first release member being mounted on said third mast adjacent a lower end thereof and engageable with said first stopper to effect release thereof from said first stop when said third mast is vertically moved into its raised position relative to said second mast; and wherein said second sequencing mechanism includes a second stop mounted on said second mast adjacent an upper end thereof, a second stopper movably mounted on said third mast adjacent an upper end thereof and being engageable with said second stop for preventing raising of said third mast when said third mast is in the lowered position, and said second release member being mounted on said fourth mast adjacent a lower end thereof and engageable with said second stopper to effect release thereof from said second stop when said fourth mast is vertically moved into its raised position relative to said third mast.

4. A lifting apparatus according to claim 3, wherein the stops and release members are fixed to the respective masts, and the stoppers each include first and second portions which respect project for engagement with the respective and releasing member.

5. A lifting apparatus according to claim 4, wherein the stopper comprises a lever swingably mounted on the respective mast and having first and second lever arms which respectively define said first and second portions, said first lever arm having a hook part movable into a position of engagement with the respective stop to prevent lifting of the mast carrying the stopper.

6. A lifting apparatus according to claim 4, wherein the stopper includes first and second stopper members which respectively define said first and second stopper portions, said first and second stopper members being movably supported on the respective mast for substantially horizontal linear displacement in opposite directions so as to project outwardly into extended positions permitting engagement with the respective stop and releasing member, said stopper also including means drivingly coupling said first and second stopper members together for causing substantially synchronous horizontal movement thereof in opposite directions, and means for normally urging said stopper members into the respective extended position.

7. A lifting apparatus according to claim 4, including locking means for (1) fixably connecting said fourth mast to said third mast when said fourth mast is in its raised position and (2) for vertically fixedly connecting said third mast to said second mast when said third mast is in its raised position relative to said second mast.

8. A lifting apparatus according to claim 7, wherein said locking means includes a first locking mechanism operatively vertically coupled between said second and third masts when in a locked position which vertically fixedly couples said second and third masts, and a second locking mechanism operatively vertically coupled between said third and fourth masts in a locked position which fixedly vertically couples said third and fourth masts.

9. A lifting apparatus according to claim 8, wherein said first locking mechanism includes a first lock part mounted on said third mast adjacent a lower end thereof and cooperating with a first locking member which is movably mounted on said second mast adjacent an upper end thereof, and a control member coupled to said locking member and cooperating with said first mast for positively locking said first locking mechanism in said locked position when said second mast is lifted upwardly relative to said first mast, said second locking mechanism being substantially identical to said first locking mechanism and positioned for cooperation with and between said second, third and fourth masts.

10. A lifting apparatus according to claim 9, wherein said lock part comprises a locking pin movably supported on the respective mast and being spring urged toward a position of locking engagement with the respective locking member when the mast carrying the locking pin is in its raised position, said locking member defining a generally downwardly-opening hook-shaped portion fixed to its respective mast and being engageable with the respective locking pin, and the control member including a first part movably supported adjacent the respective locking member and movable from a released position into a closure position for closing off the hook-shaped portion when the locking pin is engaged therewith, the control member including a second part coupled to the first part and positioned for abutting engagement with said first mast adjacent a upper end thereof when said second mast is in its lowered position for normally maintaining said first part in its released position, whereby movement of said second mast upwardly relative to said first mast causes said second part to disengage said first mast and effect movement of said first part into said closed position.

11. A lifting apparatus according to claim 1, including locking means for (1) fixably connecting said fourth mast to said third mast when said fourth mast is in its raised position and (2) for vertically fixedly connecting said third mast to said second mast when said third mast is in its raised position relative to said second mast.

12. A lifting apparatus according to claim 11, wherein said locking means includes a first locking mechanism operatively vertically coupled between said second and third masts when in a locked position which vertically fixedly couples said second and third masts, and a second locking mechanism operatively vertically coupled between said third and fourth masts in a locked position which fixedly vertically couples said third and fourth masts.

13. A lifting apparatus according to claim 12, wherein said first locking mechanism includes a first lock part mounted on said third mast adjacent a lower end thereof and cooperating with a first locking member which is movably mounted on said second mast adjacent an upper end thereof, and a control member coupled to said locking member and cooperating with said first mast for positively locking said first locking mechanism in said locked position when said second mast is lifted upwardly relative to said first mast, said second locking mechanism being substantially identical to said first locking mechanism and positioned for cooperation with and between said second, third and fourth masts.

14. A lifting apparatus according to claim 13, wherein said lock part comprises a locking pin movably supported on the respective mast and being spring urged toward a position of locking engagement with the respective locking portion when the mast carrying the locking pin is in its raised position, said locking member defining a generally downwardly-opening hook-shaped portion fixed to its respective mast and being engageable with the respective locking pin, and the control member including a first part movably supported adjacent the respective locking member and movable from a released position into a closure position for closing off the hook-shaped portion when the locking pin in engaged therewith, the control member including a second part coupled to the first part and positioned for abutting engagement with said first mast adjacent an upper end thereof when said second mast is in its lowered position for normally maintaining said first part in its released position, whereby movement of said second mast upwardly relative to said first mast causes said second part to disengage said first mast and effect movement of said first part into said closed position.

15. A lifting apparatus comprising:

a base;

a generally horizontally enlarged platform positioned above said base;

a vertically extendable mast assembly connected between said base and said platform for effecting raising and lowering of the platform relative to the base, said mast assembly having a plurality of masts including a vertically elongate first mast which is fixed to said base and projects upwardly therefrom, a vertically elongate second mast which is vertically movably supported on said first mast and is vertically movable from a lowered position adjacent said first mast into a raised position wherein said second mast projects vertically upwardly a significant extent above said first mast, a vertically elongate third mast which is vertically movably supported on said second mast and is vertically movable from a lowered position adjacent said second mast into a raised position wherein said third mast projects vertically upwardly a significant extent above said second mast, and a fourth mast which is vertically movably supported on said third mast for vertical movement between raised and lowered positions relative to said third mast, said fourth mast being fixed to said platform;

lifting means cooperating between said base and said platform for raising and lowering of said platform relative to said base, said lifting means including winding means mounted on the base, pulleys provided at upper and lower ends of each of said first, second and third masts, and cable means wound around said pulleys and having opposite ends thereof connected to the winding means and said fourth mast; and locking means for (1) fixably connecting said fourth mast to said third mast when said fourth mast is in its raised position and (2) for vertically fixedly connecting said third mast to said second mast when said third mast is in its raised position relative to said second mast.

16. A lifting apparatus according to claim 15, wherein said locking means includes a first locking mechanism operatively vertically coupled between said second and third masts when in a locked position which vertically fixedly couples said second and third masts, and a second locking mechanism operatively vertically coupled between said third and fourth masts in a locked position which fixedly vertically couples said third and fourth masts.

17. A lifting apparatus according to claim 16, wherein said first locking mechanism includes a first lock part mounted on said third mast adjacent a lower end thereof and cooperating with a first locking member which is movably mounted on said second mast adjacent an upper end thereof, and a control member coupled to said locking member and cooperating with said first mast for positively locking said first locking mechanism in said locked position when said second mast is lifted upwardly relative to said first mast, said second locking mechanism being substantially identical to said first locking mechanism and positioned for cooperation with and between said second, third and fourth masts.

18. A lifting apparatus according to claim 17, wherein said lock part comprises a locking pin movably supported on the respective mast and being spring urged toward a position of locking engagement with the respective locking members when the mast carrying the locking pin is in its raised position, said locking member defining a generally downwardly-opening hook-shaped portion fixed to its respective mast and being engageable with the respective locking pin, and the control member including a first part movably supported adjacent the respective locking member and movable from a released position into a closure position for closing off the hook-shaped portion when the locking pin is engaged therewith, the control member including a second part coupled to the first part and positioned for abutting engagement with said first mast adjacent an upper end thereof when said second mast is in its lowered position for normally maintaining said first part in its released position, whereby movement of said second mast upwardly relative to said first mast causes said second part to disengage said first mast and effect movement of said first part into said closed position.

19. A lifting apparatus comprising:

a base;

a generally horizontally enlarged platform positioned above said base;

a vertically extendable mast assembly connected between said base and said platform for effecting raising and lowering of the platform relative to the base, said mast assembly having a plurality of masts including a vertically elongate first mast which is fixed to said base and projects upwardly therefrom, a vertically elongate second mast which is vertically movably supported on said first mast and is vertically movable from a lowered position adjacent said first mast into a raised position wherein said second mast projects vertically upwardly a significant extent above said first mast, and a vertically elongate third mast which is vertically movably supported on said second mast and is vertically movable from a lowered position adjacent said second mast into a raised position wherein said third mast projects vertically upwardly a significant extent above said second mast, said third mast being fixed to said platform;

lifting means cooperating between said base and said platform for raising and lowering of said platform relative to said base, said lifting means including winding means mounted on the base, pulleys provided at upper and lower ends of each of said first and second masts, and cable means wound around said pulleys and having opposite ends thereof connected to the winding means and said third mast; and sequencing means cooperating between said plurality of masts for controlling raising of said platform from a fully lowered position to a fully raised position by first causing solely raising of said third mast followed by raising of said second and third masts as a unit.

20. A lifting apparatus according to claim 19, including vertically extendible ladder means connected between said base and said platform.

21. A lifting apparatus comprising:

a base;

two stretchable mast mechanisms each composed of a fixing mast vertically fixed to the base, a middle mast stretchable vertically relative to the fixing mast, an upper mast stretchable vertically relative to the middle mast, and a movable mast stretchable vertically relative to the upper mast;

a platform fixed to the movable masts;

winding means mounted on the base and composed of wire means wound around pulleys provided at upper and lower ends of the respective fixing, middle and upper masts and connected to the movable mast at the other end thereof;

first fixing means associated with each mast mechanism for selectively fixedly connecting the middle mast with the upper mast;

second fixing means associated with each mast mechanism for selectively fixedly connecting the upper mast with the movable mast;

a first releasing means associated with each mast mechanism for releasing the engagement between the upper mast and the middle mast when the movable mast is raised relative to the upper mast; and second releasing means associated with each mast mechanism for releasing the engagement between the middle mast and the fixing mast when the upper mast is raised relative to the middle mast.

22. A lifting apparatus comprising:

a base;

two stretchable mast mechanisms each composed of a fixing mast vertically fixed to the base, a middle mast stretchable vertically relative to the fixing mast, an upper mast stretchable vertically relative to the middle mast, and a movable mast stretchable vertically relative to the upper mast;

a platform fixed to the movable masts;

winding means mounted on the base and composed of wire means wound around pulleys provided at upper and lower ends of the respective fixing, middle and upper masts and connected to the movable mast at the other end thereof for raising the middle mast and the upper mast relative to the fixing mast;

a stopping means associated with each mast mechanism and fixed to a portion of the fixing mast;

a selective engaging means associated with each mast mechanism and fixed to the middle mast for selectively connecting with the stopping means; and an unlocking means associated with each mast mechanism and fixed to the upper mast for unlocking the engagement of the selective engaging means with the stopping means;

wherein the upper mast is moved relative to the middle mast by operating the winding means, and the middle mast is moved relative to the fixing mast by releasing the engagement of the stopping means with the selective engaging means after the unlocking means contacts the selective engaging means.

* * * * *

UNITED STATES PATENT AND TRADEMARK OFFICE

CERTIFICATE OF CORRECTION

PATENT NO. : 5 111 907

DATED : May 12, 1992

INVENTOR(S) : Mitsuhiro Kishi

It is certified that error appears in the above-identified patent and that said Letters Patent is hereby corrected as shown below:

Column 17, line 60; change "respect" to ---respectively---.

Column 17, line 61; after "respective" insert ---stop---.

Column 18, line 58; change "a" to ---an---.

Column 19, line 29; change "portion" to ---member---.

Column 19, line 37; change "in" to ---is---.

Column 20, line 47; change "members" to ---member---.

Signed and Sealed this

Twenty-eighth Day of September, 1993

Bruce Lehman

*Attest:*

BRUCE LEHMAN

*Attesting Officer*

*Commissioner of Patents and Trademarks*